US012471709B2

(12) United States Patent
Wu

(10) Patent No.: US 12,471,709 B2
(45) Date of Patent: Nov. 18, 2025

(54) SEAT ADJUSTMENT MODULE, SEAT FRAME, AND SEAT

(71) Applicant: COMFORT OFFICE FURNITURE CO., LTD GUANGDONG, Guangzhou (CN)

(72) Inventor: Yao-Chuan Wu, Chiayi (TW)

(73) Assignee: COMFORT OFFICE FURNITURE CO., LTD GUANGDONG, Guangzhou (CN)

( * ) Notice: Subject to any disclaimer, the term of this patent is extended or adjusted under 35 U.S.C. 154(b) by 212 days.

(21) Appl. No.: 18/409,741

(22) Filed: Jan. 10, 2024

(65) Prior Publication Data

US 2024/0315450 A1 Sep. 26, 2024

(30) Foreign Application Priority Data

Mar. 21, 2023 (CN) ..... 202310282874.X

(51) Int. Cl.
*A47C 1/032* (2006.01)
*A47C 1/024* (2006.01)
(Continued)

(52) U.S. Cl.
CPC ..... *A47C 1/0242* (2013.01); *A47C 1/03261* (2013.01); *A47C 1/03279* (2018.08); *A47C 3/32* (2013.01); *A47C 7/004* (2013.01)

(58) Field of Classification Search
CPC ... A47C 1/03261; A47C 1/03279; A47C 3/32; A47C 7/004
See application file for complete search history.

(56) References Cited

U.S. PATENT DOCUMENTS 5,209,548 A * 5/1993 Locher ..... A47C 1/03255 297/300.4
6,588,843 B1 * 7/2003 Ebenstein ..... A47C 1/031 297/301.4

(Continued)

FOREIGN PATENT DOCUMENTS

CN 114009990 A 2/2022
CN 216961938 U 7/2022

OTHER PUBLICATIONS

The First Chinese Office Action dated Jun. 14, 2025; Appl. No. 202310282874X (29 pages).

(Continued)

*Primary Examiner* — Rodney B White

(57) ABSTRACT

A seat adjustment module includes: a base; a stop block, configured to stop forward and backward movements of a seating member in a seat; a rotary block, configured to, in response to being rotated along a first rotation direction, drive the stop block to slide, wherein the rotary block is further configured to, in response to being rotated along a second rotation direction, open a backrest adjustment switch in the seat; a handle, rotatably connected to one end of the rotary block, and configured to, in response to being rotated with respect to the rotary block, open a lifter switch of the seat; and a twistable adjustment member, rotatably connected to the base, and configured to be connected to a backrest elastic force adjustment mechanism, wherein the twistable adjustment member is configured to adjust a magnitude of an elastic force of a backrest in the seat.

20 Claims, 24 Drawing Sheets

(51) Int. Cl.

| | |
|---|---|
| ***A47C 3/32*** | (2006.01) |
| ***A47C 7/02*** | (2006.01) |
| *A47C 7/00* | (2006.01) |

(56) References Cited

U.S. PATENT DOCUMENTS

| | | | | |
|---|---|---|---|---|
| 6,874,853 | B2 * | 4/2005 | Wild | A47C 1/03266 297/301.4 |
| 7,293,832 | B2 * | 11/2007 | Huang | A47C 1/03238 297/301.7 |
| 7,429,081 | B2 * | 9/2008 | Roslund | A47C 1/03279 297/300.4 |
| 7,500,718 | B2 * | 3/2009 | Fookes | A47C 1/03261 297/303.3 |
| 7,513,570 | B2 * | 4/2009 | Roslund | A47C 1/03266 297/300.4 |
| 7,735,923 | B2 * | 6/2010 | Roslund | A47C 1/03274 297/300.4 |
| 7,997,652 | B2 * | 8/2011 | Roslund | A47C 1/03272 297/300.4 |
| 9,402,478 | B2 * | 8/2016 | Hasegawa | A47C 1/03238 |
| 10,653,249 | B2 * | 5/2020 | Schmitz | A47C 31/126 |
| 11,166,569 | B2 * | 11/2021 | Schmitz | A47C 31/126 |
| 11,304,528 | B2 * | 4/2022 | Battey | A47C 3/20 |
| 11,357,329 | B2 * | 6/2022 | Deevers | A47C 1/0307 |
| 11,607,055 | B2 * | 3/2023 | Hu | A47C 7/441 |
| 11,612,249 | B2 * | 3/2023 | Hu | A47C 7/44 297/301.7 |
| 11,759,014 | B2 * | 9/2023 | Ni | A47C 1/03266 297/300.1 |
| 11,786,039 | B2 * | 10/2023 | Deevers | A47C 3/021 297/301.1 |
| 11,805,913 | B2 * | 11/2023 | Deevers | A47C 7/40 |
| 12,161,232 | B2 * | 12/2024 | Deevers | A47C 7/44 |
| 2006/0202530 | A1 * | 9/2006 | Lin | A47C 1/03238 297/301.7 |
| 2015/0320217 | A1 | 11/2015 | Chen | |

OTHER PUBLICATIONS

Supplementary European Search Report and European search opinion (dated Jun. 14, 2024; EP23220683.9) (7 pages).

* cited by examiner

SEAT ADJUSTMENT MODULE, SEAT FRAME, AND SEAT

CROSS-REFERENCE TO RELATED APPLICATIONS

This application claims priority to Chinese Patent Application No. 202310282874.X, filed with the Chinese Patent Office on Mar. 21, 2023, titled "SEAT ADJUSTMENT MODULE, SEAT FRAME, AND SEAT", the entire contents of which are incorporated herein by reference.

TECHNICAL FIELD

Embodiments of the present disclosure relate to the technical field of seating furniture, and in particular, relate to a seat adjustment module, a seat frame assembly, and a seat.

BACKGROUND

At present, for conventional seats, such as office chairs, gaming chairs and the like, heights and front-rear positions of seat cushions, reclining angles and support forces of backrests are adjustable.

However, due to differences in the position, force and other factors of each adjustment mechanism, it is necessary to arrange a plurality of adjustment members on the seat to achieve adjustments in cooperation with different adjustment mechanisms. During use, due to a large number of adjustment members on the seat, users are liable to make erroneous adjustments, which affects user experience.

SUMMARY

In view of the above problem, embodiments of the present disclosure provide a seat adjustment module, a seat frame assembly. A plurality of adjustment functions in the seat are integrated, such that an adjustment structure of the seat is optimized, and user experience is enhanced.

According to one aspect of the embodiments of the present disclosure, a seat adjustment module is provided. The seat adjustment module includes: a base; a stop block, slidably connected to the base, and configured to stop forward and backward movements of a seating member in a seat; a rotary block, rotatably connected to the base, and configured to, in response to being rotated along a first rotation direction, drive the stop block to slide by a transmission member to release restrictions applied by the stop block on the forward and backward movements of the seating member, wherein the rotary block is further configured to, in response to being rotated along a second rotation direction, pull a first transmission rope to move to open a backrest adjustment switch in the seat, the second rotation direction being opposite to the first rotation direction; a handle, rotatably connected to one end of the rotary block, and configured to, in response to being rotated with respect to the rotary block, pull a second transmission rope to move to open a lifter switch of the seat; and a twistable adjustment member, rotatably connected to the base, and configured to be connected to a backrest elastic force adjustment mechanism by a flexible transmission member, wherein the twistable adjustment member is configured to, in response to being rotated, adjust a magnitude of an elastic force of a backrest in the seat by the flexible transmission member.

In an optional embodiment, the rotary block is arranged to run through the base, one end of the rotary block is connected to the handle, and the twistable adjustment member is situated on an outer circumference of the handle; and a through hole configured to allow the second transmission rope to travel through is arranged in the base, the through hole being extended along the first rotation direction or the second rotation direction of the rotary block.

In an optional embodiment, a transmission structure is circumferentially arranged on the twistable adjustment member, and a driven wheel is rotatably arranged on the base, wherein the driven wheel is transmissively engaged with the transmission structure, and the flexible transmission member is connected to the driven wheel.

In an optional embodiment, the flexible transmission member includes a third transmission rope, wherein two ends of the third transmission rope are wound and secured to the driven wheel along opposite directions, the driven wheel is configured to be connected to the backrest elastic force adjustment mechanism by the third transmission rope, and the twistable adjustment member is configured to, in response to being rotated, drive, via the driven wheel and the third transmission rope, the backrest elastic force adjustment mechanism to move to adjust the magnitude of the elastic force of the backrest in the seat; or the flexible transmission member includes a flexible transmission shaft, wherein the driven wheel is configured to be connected to the backrest elastic force adjustment mechanism by the flexible transmission shaft, and the twistable adjustment member is configured to, in response to being rotated, drive, via the driven wheel and the flexible transmission shaft, the backrest elastic force adjustment mechanism to move to adjust the magnitude of the elastic force of the backrest in the seat.

In an optional embodiment, the flexible transmission shaft includes a soft shaft.

In an optional embodiment, a stop portion thereof is arranged at one end of the stop block along a slide direction, wherein the stop portion is configured to be engaged with the seating member to stop the forward and backward movements of the seating member; and an abutment portion is arranged at another end of the stop block along the slide direction thereof, wherein the transmission member is a lug arranged on a circumferential side wall of the rotary block, the rotary block is configured to, in response to being rotated with respect to the base along the first rotation direction, cause the lug to abut against the abutment portion to drive the stop block to slide such that restrictions applied by the stop block on the forward and backward movements of the seating member are released; and/or a connecting portion is arranged at another end of the stop block along the slide direction thereof, wherein the transmission member is a fourth transmission rope connected between the connecting portion and the rotary block, the rotary block is configured to, in response to being rotated with respect to the base along the first rotation direction, pull the fourth transmission rope to move to drive the stop block to slide such that restrictions applied by the stop block on the forward and backward movements of the seating member are released.

In an optional embodiment, a strip-shaped opening extending along the slide direction of the stop block is arranged in the abutment portion; wherein the lug is configured to, in response to the rotary block being rotated with respect to the base along the first rotation direction, be abutted against an inner wall at one end of the strip-shaped opening to drive the stop block to slide; and the lug is further configured to, in response to the rotary block being rotated with respect to the base along the second rotation direction, move in the strip-shaped opening but is not in structural interference with the abutment portion.

In an optional embodiment, a plurality of position engagement portions are arranged on a circumferential side wall of the rotary block, and an engagement member is arranged on the base, wherein the engagement member is configured to be engaged with different position engagement portions in response to the rotary block being rotated.

In an optional embodiment, the rotary block includes a first body and a second body, wherein the first body is connected between the handle and the second body; and a torsional elastic member is connected between the first body and the second body, and the second body is configured to drive the stop block to slide by the transmission member.

In an optional embodiment, a restoration elastic member is arranged between the stop block and the base, wherein the restoration elastic member is configured to apply a restoration elastic force to the stop block, such that the stop block is automatically restored and engaged with the seating member when no force is applied by the rotary block.

According to another aspect of the embodiments of the present disclosure, a seat frame assembly is provided. The seat frame assembly includes: a frame and the seat adjustment module as described above, wherein the seat adjustment module is arranged on the frame.

In an optional embodiment, the frame includes a support frame and a seating member frame, wherein the seating member frame is forward and backward slidably connected to the support frame; the seat adjustment module is arranged on the support frame, and the seat adjustment module is situated at a junction between the support frame and the seating member frame; and a slidable position section is arranged on the seating member frame, wherein the stop block is in a snap-fit engagement with the slidable position section.

In an optional embodiment, the frame includes a backrest, and the support frame includes a chassis, an elastic sheet being arranged the chassis and the backrest; wherein a fulcrum structure is arranged on the chassis, the fulcrum structure being abutted against the elastic sheet such that the elastic sheet supplies a support elastic force to the backrest; a rotatable adjustment member is connected to the fulcrum structure, and the flexible rotation member includes a flexible rotary shaft, wherein the flexible rotary shaft is connected to the rotatable adjustment member, and the twistable adjustment member is configured to, in response to being rotated, drive the rotatable adjustment member to rotate by the flexible rotary shaft, such that the fulcrum structure slides with respect to the chassis to alter a magnitude of the support elastic force supplied by the elastic sheet to the backrest; or a tension mechanism is arranged on the chassis, and the flexible rotation member comprises a third transmission rope, wherein the third transmission rope is wound on the tension mechanism, two ends of the third transmission rope are wound and secured on the twistable adjustment member along an opposite direction, and the third transmission rope is securely connected to the fulcrum structure; and when the twistable adjustment member is rotated, the fulcrum structure is driven by the third transmission rope to slide with respect to the chassis to alter a magnitude of the support elastic force supplied by the elastic sheet to the backrest.

According to still another aspect of the embodiments of the present disclosure, a seat is provided. The seat includes the seat frame assembly as described above.

In summary, in the seat adjustment module according to the embodiments of the present disclosure, by integrating the stop block on the base, it is ensured that the transmission member driving the stop block to slide has sound stability. By causing the rotary block to rotate along two opposite directions, the function of adjusting forward and backward movements of the seating member and the function of adjusting the reclining angle of the backrest are implemented. By causing the handle to rotate with respect to the rotary block, lift adjustment is achieved for the seat. In the meantime, the twistable adjustment member is rotatably integrated on the base, and direction-variable driving on the backrest elastic force adjustment mechanism by the twistable adjustment member is achieved via the flexible transmission member. In this way, the magnitude of the elastic force of the backrest is adjusted. The entire seat adjustment module has a compact structure and has a high integration of functions. During use, the user may not be confused in adjustment functions, and thus user experience is greatly improved.

The above description only summarizes the technical solutions of the present disclosure. Specific embodiments of the present disclosure are described hereinafter to better and clearer understand the technical solutions of the present disclosure, to practice the technical solutions based on the disclosure of the specification, and to make the above and other objectives, features and advantages of the present disclosure more apparent and understandable.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference numerals denote like parts. In the drawings.

REFERENCE NUMERALS IN THE EMBODIMENTS AND DENOTATIONS THEREOF

Figure 1:
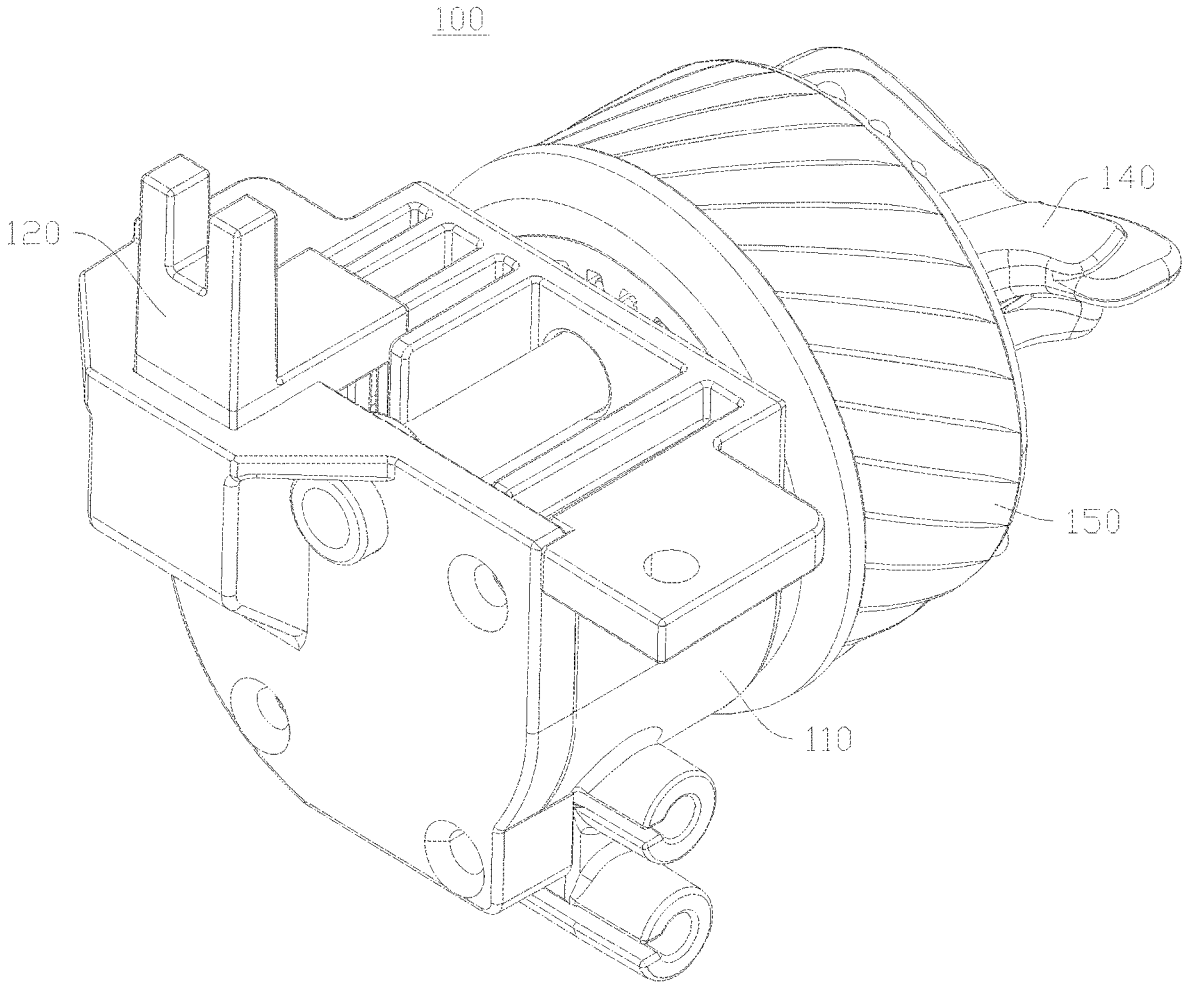
FIG. 1 is a schematic structural view of a seat adjustment module according to an embodiment of the present disclosure.

100—Seat adjustment module; 110—base; 111—first passing hole; 112—second passing hole; 113—engagement member; 114—accommodation recess; 115—through hole; 116—first leading hole; 117—second leading hole; 120—stop block; 121—stop portion; 122—abutment portion; 1221—strip-shaped opening; 123—stop recess; 130—rotary block; 131—transmission member; 132—first mounting recess; 133—position engagement portions; 134—first body; 1341—first engagement recess; 1342—stop chute; 13421—first abutment inner wall; 13422—second abutment inner wall; 135—second body; 1351—second engagement recess; 1352—stop sliding block; 136—torsional elastic member; 1361—first stress end; 1362—second stress end; 140—handle; 141—second mounting recess; 150—twistable adjustment member; 1501—transmission structure; 1502—driven wheel; 15021—a first passing slot; 15022—second passing slot; 151—rack; 152—gear; 1521—mounting bar; 15211—third mounting recess; 160—second transmission rope; 170—third transmission rope; 171—fixed connection portion; 180—first transmission rope; 190—compressive spring; 191—flexible transmission shaft; 192—connection portion; 193—fourth transmission rope;

200—seating member frame; 210—slidable position section;

300—support frame;

400—backrest;

500—chassis; 501—backrest adjustment switch; 5011—sliding block; 5012—backrest position structure; 5013—torsional spring; 510—first guiding structure; 520—pneumatic mounting hole; 530—pressing structure; 540—second guiding structure; 550—elastic sheet; 560—fulcrum structure; 570—screw; 580—rotary shaft; 590—tension mechanism;

1000—seat frame assembly; 1100—frame; and

2000—seat.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

Unless defined otherwise, all technical and scientific terms used herein have the same meaning as commonly understood by one of ordinary skill in the art to which the present disclosure pertains. The terms used herein in the specification of present disclosure are only intended to illustrate the specific embodiments of the present disclosure, instead of limiting the present disclosure. The terms "comprise," "include," and any variations thereof in the specification, claims, and the description of the drawings of the present disclosure are intended to cover a non-exclusive inclusion.

In the description of the present disclosure, the terms "first," "second," and the like are only used for distinguishing different objects, but shall not be understood as indication or implication of relative importance or implicit indication of the number of the specific technical features, the specific sequence or priorities. In the description of the embodiments of the present disclosure, the term "multiple" or "a plurality of" signifies at least two, unless otherwise specified.

The terms "example" and "embodiment" in this specification signify that the specific characteristic, structures or features described with reference to the embodiments may be covered in at least one embodiment of the present disclosure. This term, when appearing in various positions of the description, neither indicates the same embodiment, nor indicates an independent or optional embodiment that is exclusive of the other embodiments. A person skilled in the art would implicitly or explicitly understand that the embodiments described in this specification may be incorporated with other embodiments.

In the description of the embodiments of the present disclosure, the term "and/or" is merely an association relationship for describing associated objects, which represents that there may exist three types of relationships, for example, A and/or B may represent three situations: only A exists, both A and B exist, and only B exists. In addition, the forward-slash symbol "/" generally represents an "or" relationship between associated objects before and after the symbol.

In the description of the embodiments of the present disclosure, the term "multiple" or "a plurality of" signifies more than two (including two), unless otherwise specified. Likewise, the term "a plurality of groups" or "multiple groups" signifies more than two groups (including two groups), and the term "a plurality of pieces" or "multiple pieces" signifies more than two pieces (including two pieces).

In the description of the embodiments of the present disclosure, it should be understood that the terms "central," "transversal," "longitudinal," "length," "width," "thickness," "upper," "lower," "front," "rear," "left," "right," "vertical," "horizontal," "top," "bottom," "inner," "outer," "clockwise," "counterclockwise," "axial," "radial," "circumferential," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In the description of the embodiments of the present disclosure, it should be noted that unless otherwise specified and defined, the terms "mounted," "coupled," "connected," "secured," and derivative forms thereof shall be understood in a broad sense, which, for example, may be understood as secured connection, detachable connection or integral connection; may be understood as mechanical connection or electrical connection, or understood as direct connection, indirect connection via an intermediate medium, or communication between the interiors of two elements or interactions between two elements. Persons of ordinary skill in the art may understand the specific meanings of the above terms in the embodiments of the present disclosure according to the actual circumstances and contexts.

In a conventional seat, generally a height of a seat cushion is adjusted by a height adjustment lever at the bottom of the seat. Specifically, when a user raises one end of the height adjustment lever, the height adjustment lever is rotated, such that another end of the height adjustment lever is lowered down and presses a pneumatic valve on a pneumatic bar, which facilitates adjustment of the height of the seat cushion. The similar principle applies for adjustment of backrest reclining. Specifically, when one end of a reclining adjustment lever at the bottom of the seat is raised, the reclining adjustment lever is rotated, such that another end of the reclining adjustment lever is lowered down, and hence a catch block at the another end is disengaged from backrest reclining position recesses. In this way, a backrest reclining angle is adjusted.

With respect to the adjustment of an elastic force of a backrest, generally a twist bar is extended at an elastic force adjustment section on a chassis. By rotating the twist bar, a fulcrum position of an elastic sheet supplying an elastic force to the backrest in the chassis is adjusted, and the elastic force of the backrest is adjusted.

For the adjustment of forward and backward movements of the seat cushion, typically a split-type structure is adopted. Specifically, position recesses are arranged at a junction where a support frame is slidably connected to a side of a seat cushion frame, the seat cushion frame is provided with a clamping block, and an adjustment mechanism on the same side of the support frame pulls the clamping block on the seat cushion frame to slide via a steel rope, such that the clamping block is disengaged from the position recesses, such that the forward and backward movements of the seat cushion frame are unlocked. With regard to this adjustment approach, since the clamping block is provided on the seat cushion frame and moves forward and backward together with the seat cushion frame, and the adjustment mechanism is secured on the support frame and the position thereof may not be changed, it is necessary to provide the two as separate structures and implement transmission of a tensile force by steel rope connection. A protective sleeve with two ends thereof respectively connected to the clamping block and the adjustment mechanism is sleeved onto the outside of the steel rope, to ensure that the steel rope is capable of moving in the protective sleeve when being pulled, thereby unlocking the clamping block. However, during forward and backward adjustments of the seat cushion, a relative position between the clamping block and the adjustment mechanism may be changed, such that the steel rope between the clamping block and the adjustment mechanism and the protective sleeve outside the steel rope are deformed repeatedly, which reduces the service life of the steel rope and the protective sleeve. In addition, when a distance between the clamping block and the adjustment mechanism is reduced, the two ends of the steel rope and the protective sleeve are close to each other, and consequently, the middle part of the steel rope and the protective sleeve is elongated and easily rubbed with other parts on the support frame, resulting in the wear of the protective sleeve, and further reducing the service life of the protective sleeve.

It can be seen from the above that, in the conventional seat, since the adjustment function is complex, a large number of adjustment mechanisms are desired and these mechanisms are densely distributed. Therefore, users may be easily confused in recognizing and using corresponding functions of the adjustment mechanisms, and thus user experience is affected.

In view of the above-mentioned problems, the inventors of the present disclosure devise an integrated adjustment module to simultaneously adjust multiple functions of a seat. Based on this, the inventors take into consideration that since the parts for implementing different functions in the seat are arranged at different positions, how to design the structures of the adjustment module and a transmission member, and how to use a movement relationship between the adjustment module and the transmission member are challenging in achieving integration of the adjustment module.

In order to achieve the above object, the inventors have studied that, forward and backward movements of the seating member and the reclining angle of the backrest are adjusted by rotation of the rotary block on the base in two opposite rotation directions is used. Specifically, when the rotary block is rotated in a first rotation direction, the stop block is driven, via the transmission member, to slide to release the restriction on the forward and backward movements of the seating member, and the forward and backward movements of the seat cushion are adjusted; and when the rotary block is rotated in a second rotation direction, a first transmission rope is pulled to move, and then the first transmission rope opens a lock member for adjusting the reclining angle of the backrest to adjust the reclining angle of the backrest.

Since the stop block is integrated on the base, a relative position between the stop block and the rotary block is not changed, thereby ensuring the stability of the structure.

With regard to the lift adjustment of the seat cushion, a handle rotatably connected to the rotary block is used to achieve the lift adjustment for the seat cushion. Specifically, when the handle is rotated with respect to the rotary block, a second transmission rope is pulled to move, and the second transmission rope then pulls a press member on a pneumatic bar on the seat, such that the press member presses a pneumatic valve on the pneumatic bar to achieve the lift adjustment for the seat cushion.

An elastic force of the backrest is adjusted by means of a twistable adjustment member in combination with a flexible transmission member. Specifically, when the twistable adjustment member is rotated, a support position of a fulcrum structure on a chassis to an elastic sheet is adjusted via the flexible transmission member, so as to alter a magnitude of a support elastic force applied by the elastic member to the backrest. In this way, the magnitude of the elastic force of the backrest is adjusted.

Figure 2:
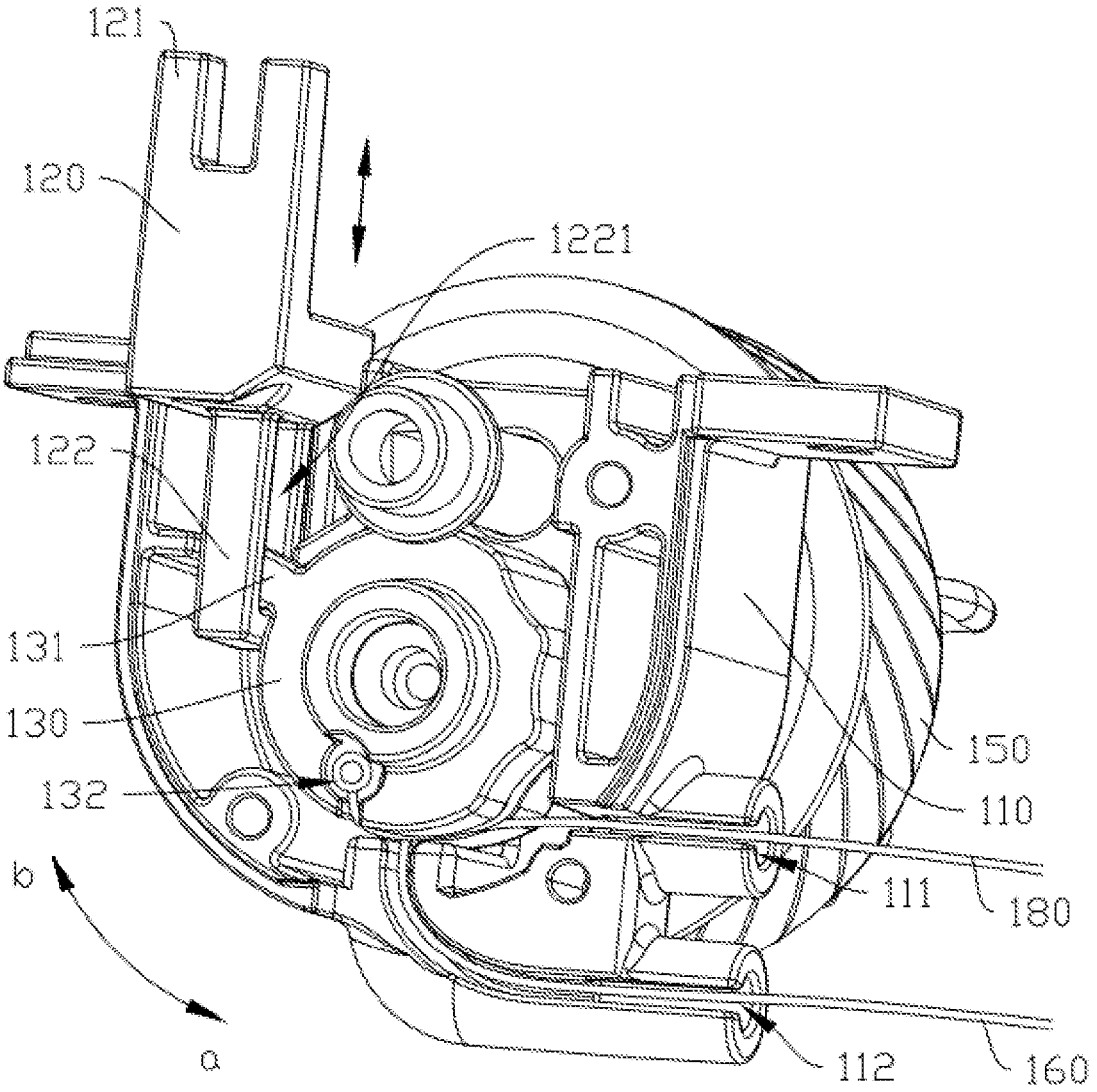
FIG. 2 is a schematic structural view of an interior of a seat adjustment module according to an embodiment of the present disclosure.

Based on the above inventive concept, according to one aspect of the embodiments of the present disclosure, a seat adjustment module is provided. Referring to FIG. 1 and FIG. 2, FIG. 1 illustrates a three-dimensional structure, taken from a view angle, of a seat adjustment module 100 according to an embodiment of the present disclosure, and FIG. 2 illustrates an internal structure of the seat adjustment module 100. As illustrated in FIG. 1 and FIG. 2, the seat adjustment module 100 includes: a base 110, a stop block 120, a rotary block 130, a handle 140, and a twistable adjustment member 150. The stop block 120 is slidably connected to the base 110, and is configured to stop forward and backward movements of a seating member in a seat. The rotary block 130 is rotatably connected to the base 110, and is configured to, in response to being rotated along a first rotation direction (a direction indicated by an arrow a in FIG. 2), drive the stop block 120 to slide by a transmission member 131 to release restrictions applied by the stop block 120 on the forward and backward movements of the seating member. The rotary block 130 is further configured to, in response to being rotated along a second rotation direction (a direction indicated by an arrow b in FIG. 2), pull a first transmission rope 180 to move to open a backrest adjustment switch in the seat, wherein the second rotation direction is opposite to the first rotation direction.

Figure 3:
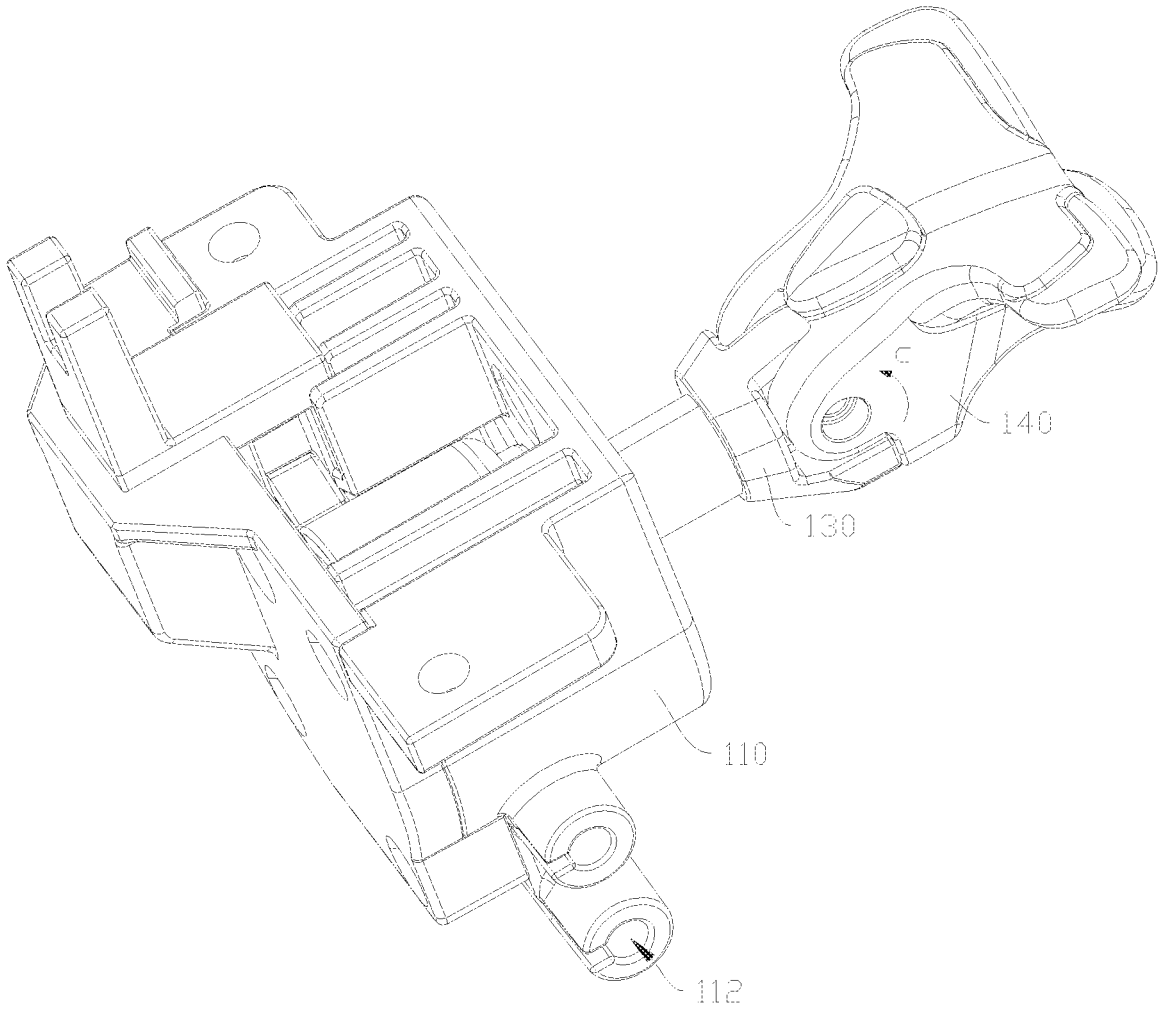
FIG. 3 is a schematic structural view of a seat adjustment module with a twistable adjustment member removed according to an embodiment of the present disclosure.
Figure 4:
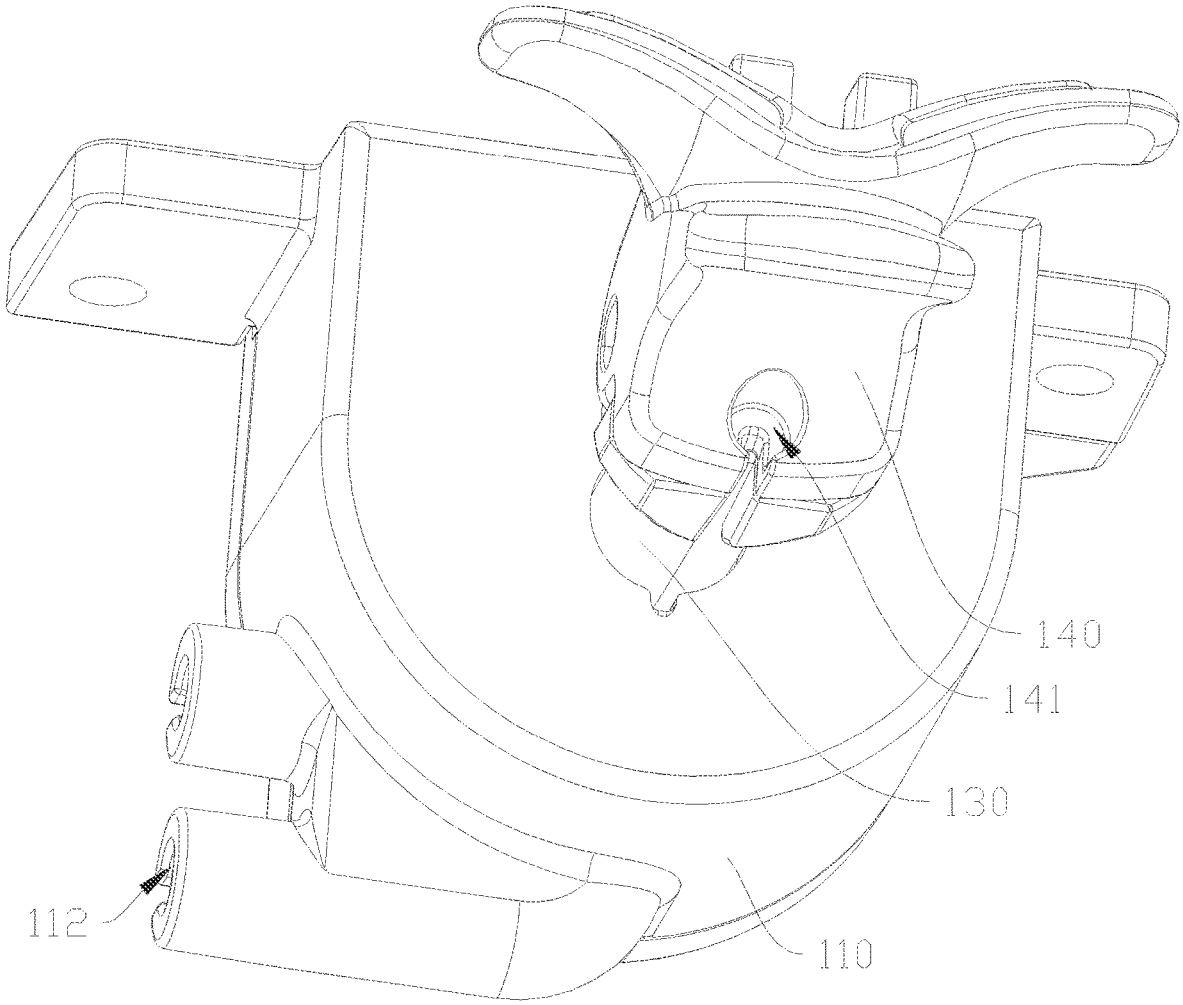
FIG. 4 is a schematic structural view of a seat adjustment module with a twistable adjustment member removed, taken from another view angle, according to an embodiment of the present disclosure.

Referring to FIG. 3 and FIG. 4, structures of a handle from two view angles are respectively illustrated. As illustrated in FIG. 3 and FIG. 4, the handle 140 is rotatably connected to one end of the rotary block 130, and is configured to, in response to being rotated with respect to the rotary block 130, pull a second transmission rope (not illustrated) to move to open a lifter switch of the seat.

Still referring to FIG. 1, the twistable adjustment member 150 is rotatably connected to the base, and the twistable adjustment member 150 is configured to be connected to a backrest elastic force adjustment mechanism by a flexible transmission member (not illustrated), and is configured to, in response to being rotated, adjust an elastic force of a backrest in the seat by the flexible transmission member.

Figure 5:
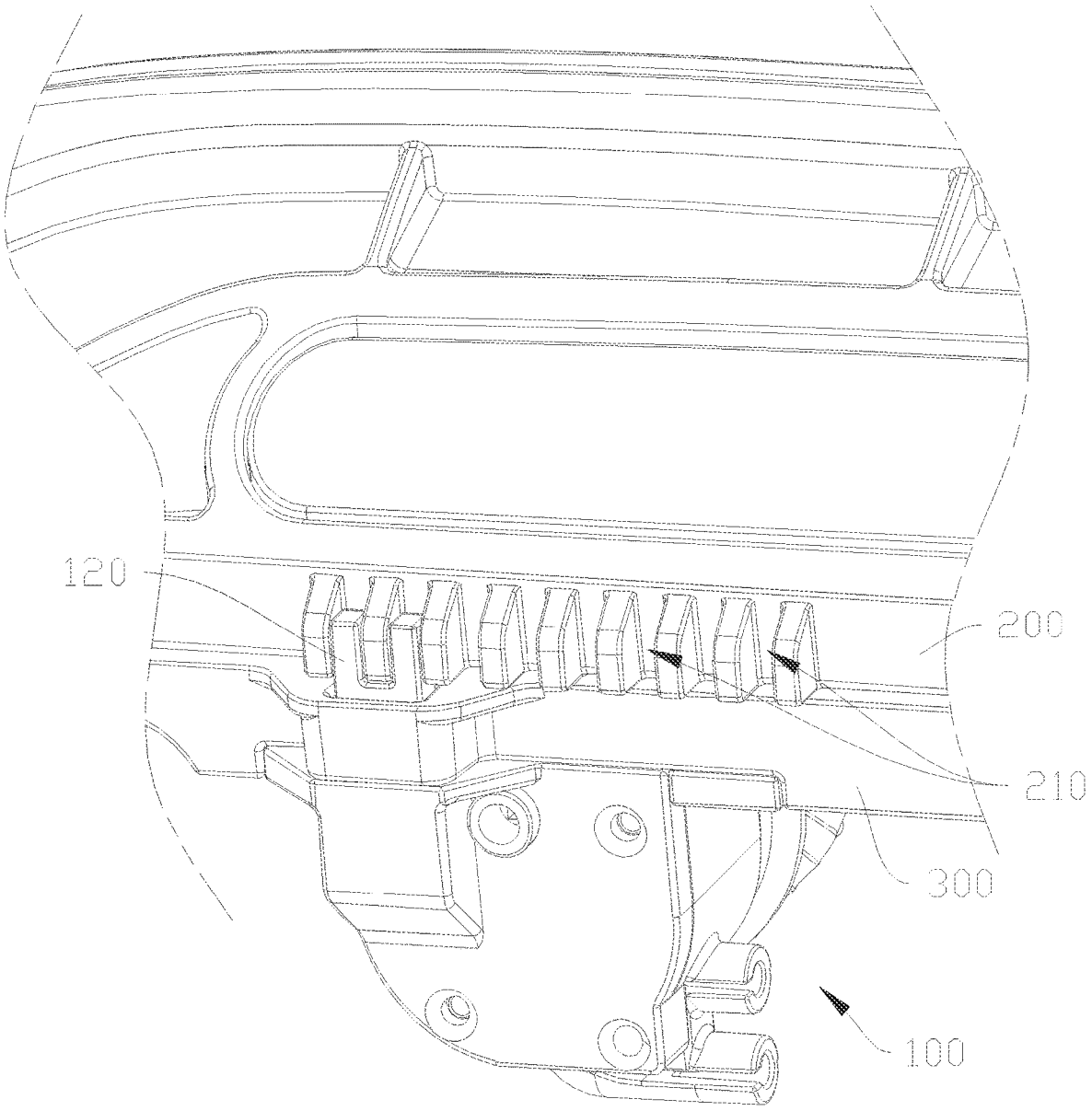
FIG. 5 is a schematic partial structural view of a scenario where a seat adjustment module is secured to a seat frame assembly according to an embodiment of the present disclosure.

With respect to the fashion of restricting forward and backward movements of the seating member by the stop block 120, reference may be made to FIG. 2, and further made to FIG. 5 which illustrates an application scenario of the seat adjustment module. As illustrated in FIG. 5, a seating member frame 200 is slidably connected a support frame 300 along a front-rear direction, a slidable position section 210 is arranged on the seating member frame 200, the seat adjustment module 100 is mounted on the support frame 300, and the stop block 120 is in snap-fit engagement with the slidable position section 210 to restrict forward and backward movements of the seating member frame 200. The rotary block 130, in response to being rotated along the direction indicated by the arrow a in FIG. 2, drives the stop block 120 to move downward, such that the stop block 120 is disengaged from the slidable position section 210. In this way, front and rear positions of the seating member frame 200 are adjusted. It should be noted that the transmission member 131 may be a lug arranged on a circumferential side wall of the rotary block 130 as illustrated in FIG. 2, or may be a pull rope secured to the circumferential side wall of the rotary block 130, and the rotary block 130, in response to being rotated, drives the stop block 120 to move by the lug or pulls the stop block to move by the pull rope.

With respect to the fashion of opening the backrest adjustment switch by the rotary block 130, still referring to FIG. 2, a mounting recess 132 may be arranged in one end of the rotary block 130, a first passing hole 111 is arranged in the base 110, a first passing channel is defined between the first mounting recess 132 and the first passing hole 111, and the first passing channel runs through at least part of the circumferential side wall of the rotary block 130. One end of the first transmission rope 180 is secured into the first mounting recess 132, the first transmission rope 180 is extended along the first passing channel to pass through the first passing hole 111, and another end of the transmission rope 180 is connected to the backrest adjustment switch. It may be understood that the first mounting recess 132 may not be arranged, the first transmission rope 180 is securely connected to the rotary block 130 by threads or the like fashions, and when the first rotary block 130 is a metal structure, the first transmission rope 180 may also be securely connected to the rotary block 130 by welding.

Figure 6:
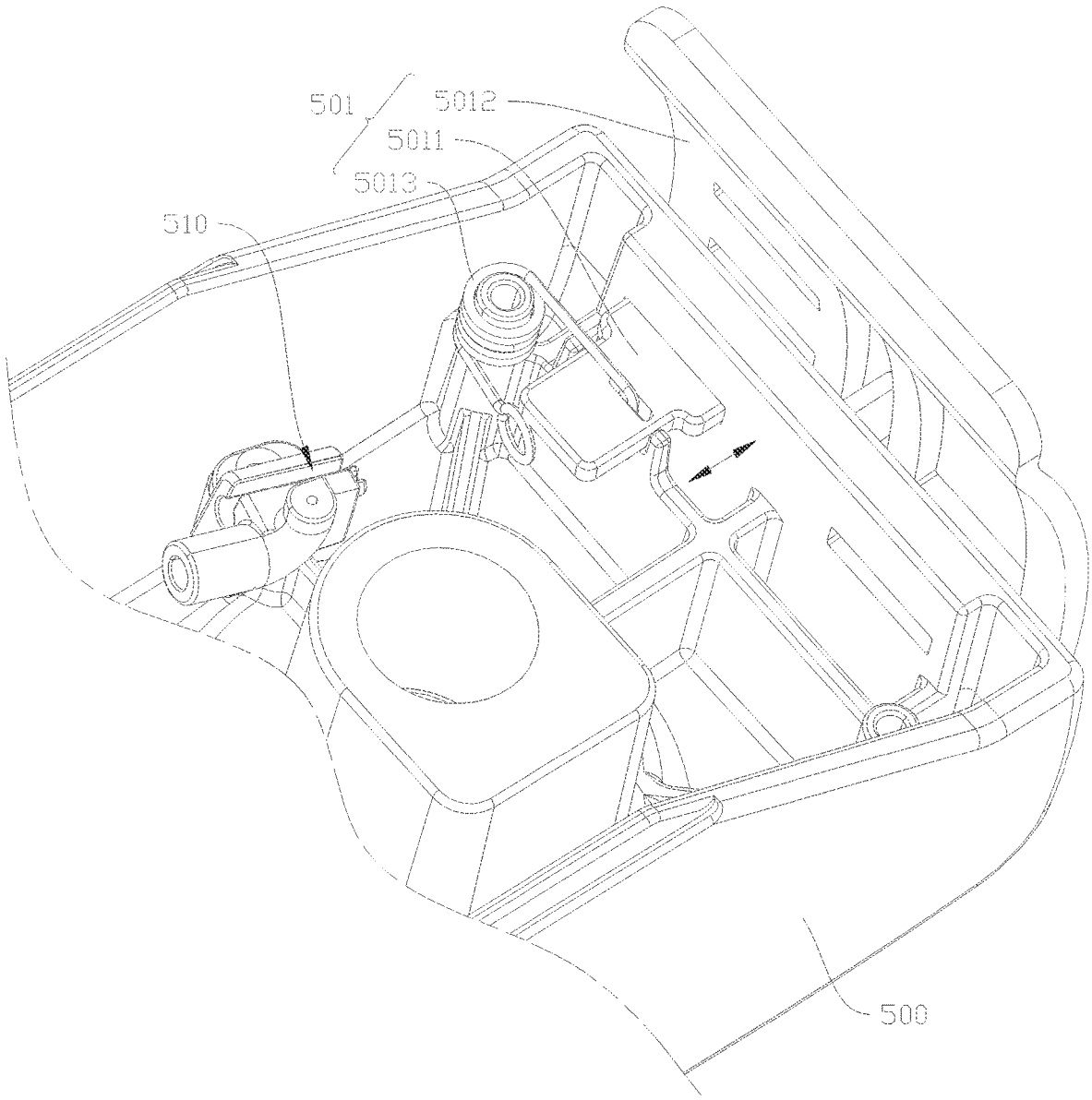
FIG. 6 is a schematic partial structural view of an interior of a chassis in a seat according to an embodiment of the present disclosure.

With respect to the structure of the backrest adjustment switch, referring to FIG. 6, a backrest adjustment switch 501 includes a sliding block 5011 and a backrest position structure 5012. The sliding block 5011 is slidably arranged on a chassis 500 along directions indicated by arrows in FIG. 6. The sliding block 5011 is in snap-fit engagement with a docking recess in the backrest position structure 5012 to restrict reclining rotation of the backrest. The first transmission rope (not illustrated in FIG. 6) is passed out one end of the first passing hole 111 and is connected to the sliding block 5011, such that when the first transmission rope is displaced in response to being pulled by the rotary block 130, the first transmission rope drives the sliding block 5011 to slide backward along the directions indicated by the arrows in FIG. 6. In this way, the sliding block 5011 is disengaged from the docking recess in the backrest position structure 5012, such that the backrest switch 501 is unlocked.

Further, as illustrated in FIG. 6, a torsional spring 5013 may also be rotatably arranged on the chassis 500. One end of the torsional spring 5013 is connected to the sliding block 5011, and another end of the torsional spring 5013 is connected to an end portion of the first transmission rope. The first transmission rope may pull one end of the torsional spring 5013, such that the torsional spring 5013 is rotated, and another end of the torsional spring 5013 drives the sliding block 5011 to slide backward along the directions indicated by the arrows in FIG. 6, thereby achieving unlocking. With the torsional spring 5013, when the user is leaning against the backrest such that the sliding block 5011 is dead-locked in the backrest position structure 5012, the first transmission rope is still normally subject to displacement and hence drives one end of the torsional spring 5013 connected to the first transmission rope whereas one end of the torsional spring 5013 connected to the sliding block 5011 is not subject to rotation because sliding of the sliding block 5011 is restricted. In this case, the torsional spring 5013 itself has a restoration elastic force, and when the back of the user leaves from the backrest and the user is about to adjust the backrest reclining angle, dead-lock of the sliding block 5011 in the backrest position structure 5012 is released, and the sliding block 5011 slides backward under the effect of the elastic force supplied by the torsional spring 5013, such that the sliding block is disengaged and unlocked from the docking recess in the backrest position structure 5012.

Further, as illustrated in FIG. 6, a first guiding structure 510 may also be arranged on the chassis 500. The first transmission rope is passed through the first guiding structure 510 and is connected to the torsional spring 5013. The first guiding structure 510 is configured to restrict and guide an extension direction of the first transmission rope, such that the first transmission rope applies a pull force in a more suitable direction. A spring may also be arranged between an output end (that is, one end facing towards the torsional spring 5013 in FIG. 6) of the first guiding structure 510 and an end, connected to one end of the first transmission rope, of the torsional spring 5013. The spring may be sleeved on this section of the first transmission rope. When the first transmission rope is pulled, the torsional spring 5013 is rotated such that the spring is compressed. When the first transmission rope is released, the spring is extended to restore from deformation and pushes the torsional spring 5013 to rotate reversely, such that the sliding block 5011 slides forward and is in snap-fit engagement with the docking recess in the backrest position structure 5012. In this way, the backrest adjustment switch 501 is automatically restored and locked. It may be understood that with respect to an example where no torsional spring 5013 is arranged, a spring may also be directly arranged between the first guiding structure 510 and the sliding block 5011, such that the sliding block 5011 is automatically restored.

Hereinabove, the specific structures for adjustment of the forward and backward movements of the seating member and adjustment of the reclining angle of the backrest are described. It should be noted herein that with respect to the view angle as illustrated in FIG. 2, when the rotary block 130 according to the specific embodiment as illustrated in FIG. 2 is counterclockwise rotated, the stop block 120 is driven to move to unlock the forward and backward movements of the seating member; and when the rotary block 130 is clockwise rotated, the first transmission rope 180 is pulled, such that the backrest adjustment switch is unlocked. In other embodiments, the stop block 120 may also be on another side opposite to the rotary block 130, and the first transmission rope 180 is extended along another opposite direction, such that the rotary block 130 has a rotation direction rightly opposite to the direction as illustrated in FIG. 2 during unlocking the forward and backward movements of the seating member and unlocking the backrest adjustment switch.

Figure 7:
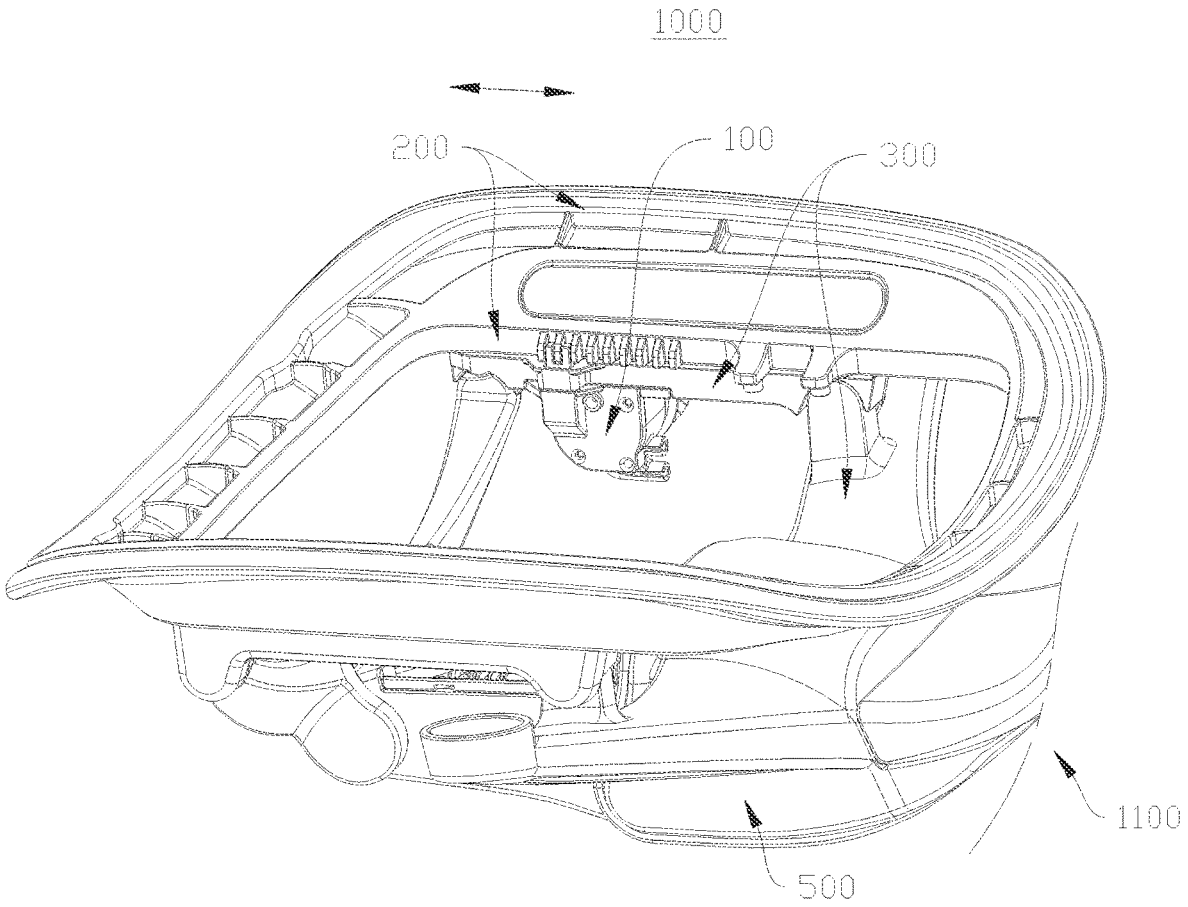
FIG. 7 is a schematic structural view of a seat frame assembly according to an embodiment of the present disclosure.

With respect to the corresponding relationship between the rotation direction and the adjustment function of the rotary block 130, the present disclosure provides a preferred example. Specifically, referring to FIG. 7, a structure of a seat frame assembly according to an embodiment of the present disclosure is illustrated. As illustrated in FIG. 7, the seat adjustment module 100 is arranged at a junction between the support frame 200 and the seating member frame 300, and when the user is seated on the seat, the seat adjustment module 100 is situated under the right hand of the user. In further combination with FIG. 2 and FIG. 7, the handle 140 faces towards an outer side of the seat frame assembly, and the user may rotate the handle 140 with the right hand to drive the rotary block 130 to rotate, such that the corresponding adjustment function is implemented. When the user forward twists (equivalent to counterclockwise twisting in the view angle as illustrated in FIG. 7) the handle 140 with the right hand, the function of adjusting the forward and backward movements of the seating member is unlocked. When the user backward twists (equivalent to clockwise twisting in the view angle as illustrated in FIG. 7) the handle 140 with the right hand, the function of adjusting the reclining angle of the backrest is unlocked. Such configurations more accommodate user's habits, and the user is prevented from mis-adjustment during use.

With respect to the adjustment of the lifter switch, first in combination of FIG. 2, FIG. 3, and FIG. 4, a second mounting recess 141 may be arranged in the handle 140, and a second passing hole 112 may be arranged in the base 110. A second passing channel is defined between the first mounting recess 141 and the second passing hole 112. One end of the second transmission rope is secured into the second mounting recess 141. The second transmission rope is extended out of the second passing hole 112 along the second passing channel, and is connected to the lifter switch. In response to being rotatably lifted along a direction indicated by an arrow c in FIG. 3, the handle 140 pulls the second transmission rope to move. It may be understood that the arrow c in FIG. 3 is drawn on the structure of the handle 140, which is merely for description of the rotation direction of the handle 140. In a practical product, the arrow c is not necessarily marked on the handle 140. It should be noted that to accommodate user's habits, in the specific embodiment as illustrated in FIG. 3, a structure configured to drive the second transmission rope to move when the handle 140 is rotatably lifted. However, in other embodiments, the second transmission rope may also be driven to move by rotatably pressing down the handle 140, or by rotatably pushing forward or merely rotating the handle 140, which is not limited herein.

Figure 8:
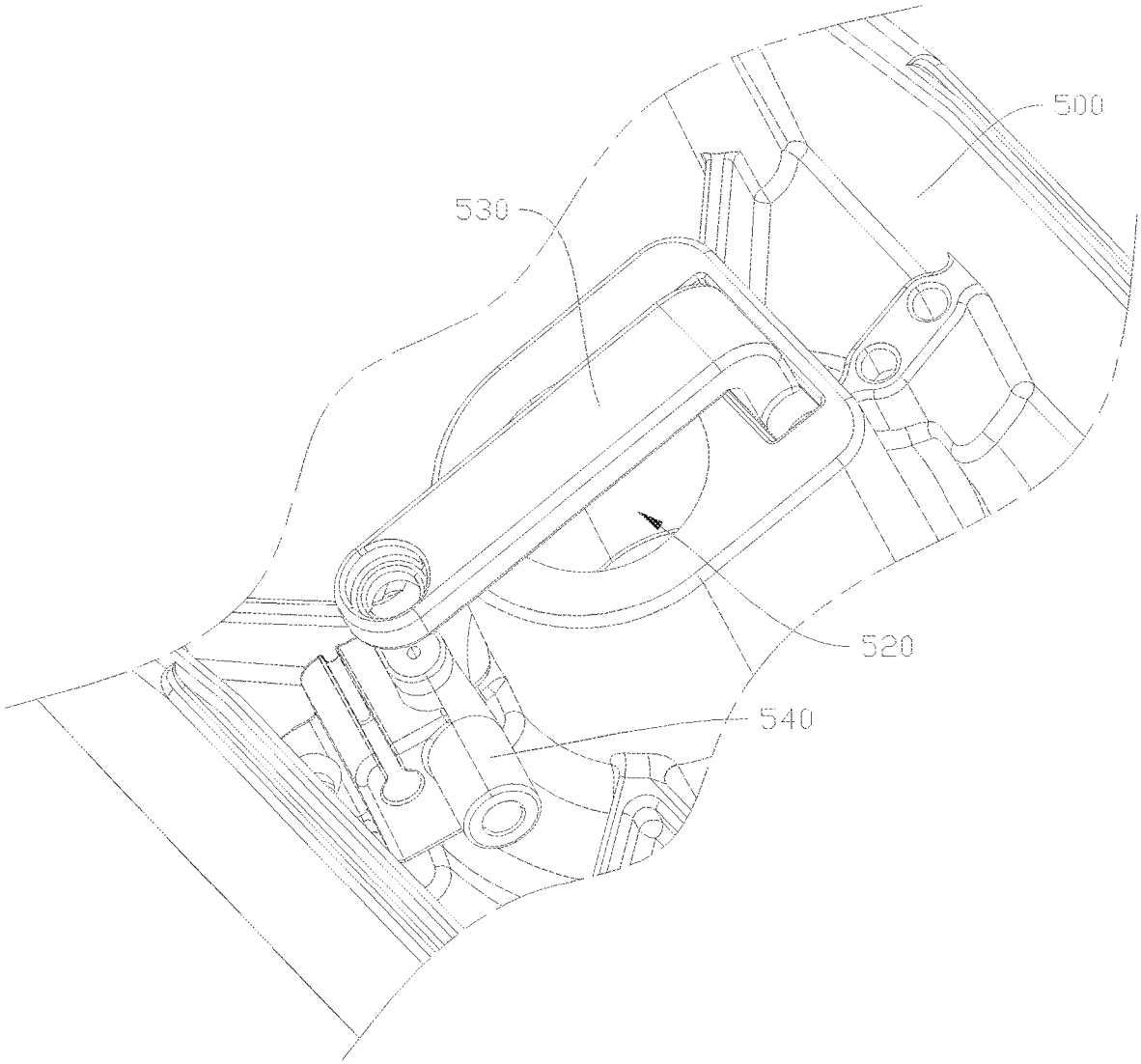
FIG. 8 is a schematic partial structural view of a lifter switch in a chassis in a seat according to an embodiment of the present disclosure.

With respect to the structure of the lifter switch, reference may be made to FIG. 8. As illustrated in FIG. 8, a pneumatic bar mounting hole 520 is arranged in the chassis 500, and a top end of a pneumatic bar (not illustrated) supporting the chassis 500 is arranged in the pneumatic bar mounting hole 520. In addition, a pneumatic valve is arranged at the top end of the pneumatic bar. When the pneumatic valve is pressed down, lift adjustment is achieved for the pneumatic bar. As illustrated in FIG. 8, the lifter switch includes a pressing structure 530 rotatably arranged on the pneumatic bar mounting hole 520, and a second guiding structure 540 is further arranged on the chassis 500. The second transmission rope travels through the second guiding structure 540, and then is extended along a longitudinal direction and is securely connected to an end portion of the pressing structure 530. In response to moving under a pull force, the second transmission rope pulls the pressing structure 530 to rotate downward, and the pressing structure 530 presses down and open the pneumatic valve on the pneumatic bar, such that lift adjustment is achieved for the seat.

With respect to the adjustment of an elastic force of the backrest, specifically, the twistable adjustment member 150 may employ a rotation bar (not illustrated) rotatably connected to the base 110, and the flexible transmission member may employ a flexible transmission shaft (not illustrated in FIG. 1). One end of the rotation bar is connected to one end of the flexible transmission shaft. When the user rotates the rotation bar, the rotation bar drives the flexible transmission shaft to rotate.

Figure 9:
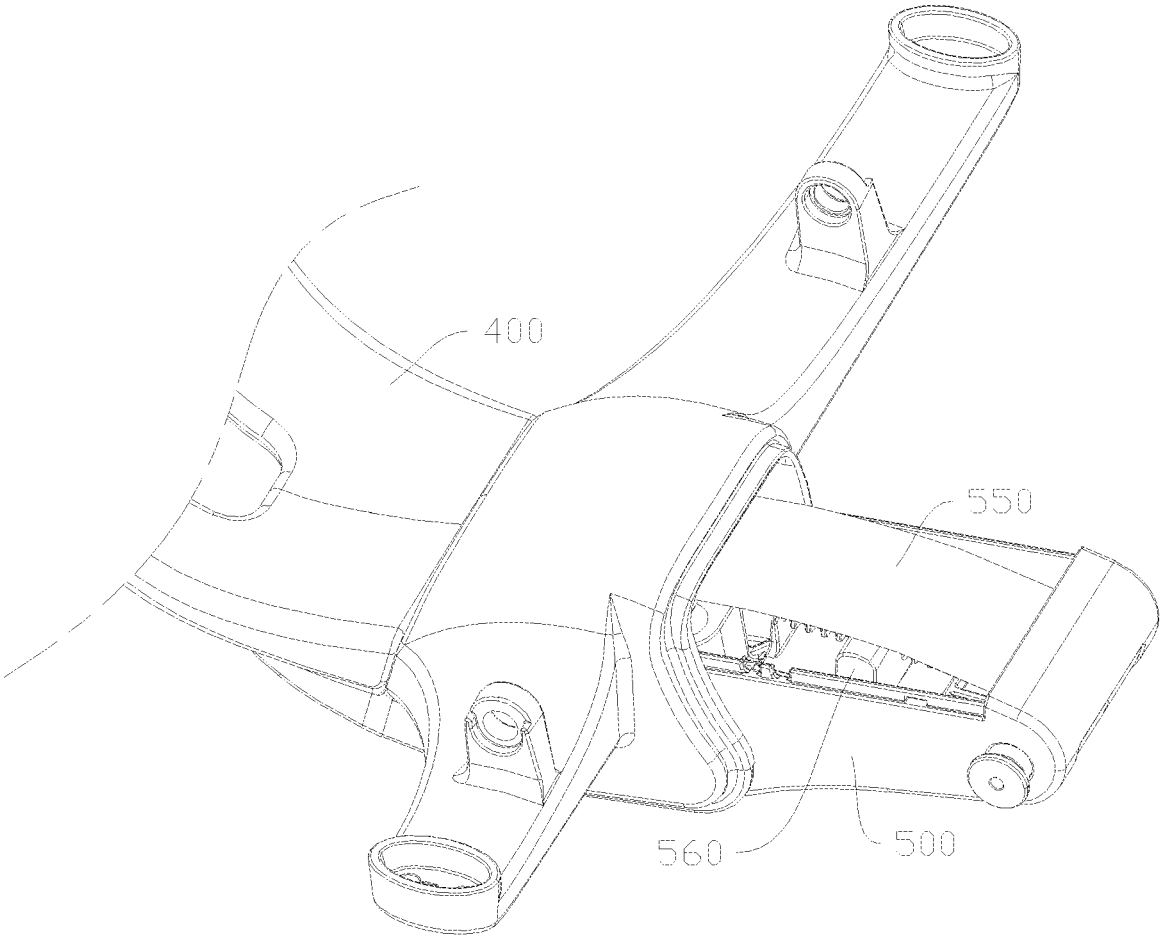
FIG. 9 is a schematic structural view of a junction of a chassis and a backrest in a seat according to an embodiment of the present disclosure.

Referring to FIG. 9, a backrest elastic structure of the backrest is illustrated. As illustrated in FIG. 9, an elastic sheet 550 is arranged on the chassis 500, and a backrest 400 is rotatably connected to the chassis 500. Two ends of the elastic sheet 550 are respectively abutted against the chassis 500 and the backrest 400, such that the elastic sheet 500 is pressed tightly between the chassis 500 and the backrest 400 to supply a support elastic force to the backrest 400. A fulcrum structure 560 is arranged on the chassis 500. The fulcrum structure 560 is supported at a bottom of the elastic sheet 550 to supply a fulcrum for bending deformation to the elastic sheet 550.

Figure 10:
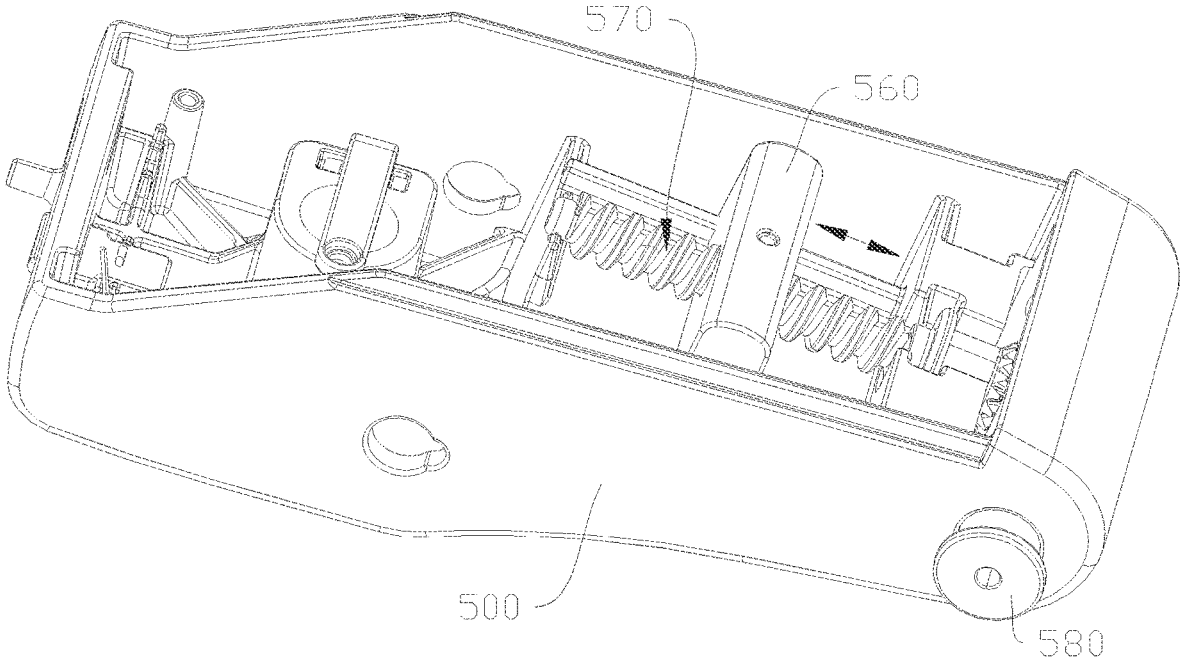
FIG. 10 is a schematic structural view of a chassis in a seat frame assembly according to an embodiment of the present disclosure.

Referring to FIG. 10, an internal structure of the chassis is illustrated. As illustrated in FIG. 10, a screw 570 is rotatably arranged in the chassis 500. The screw 570 is threaded to the fulcrum structure 560, such that in response to being rotated, the screw 570 drives the fulcrum structure 560 to move along an axial direction (directions indicated by arrows in FIG. 10) of the screw 570 to adjust a support position of the fulcrum structure 560 on the elastic sheet 550, such that a magnitude of the elastic force supplied by the elastic sheet 550 to the backrest 400 is altered.

Still referring to FIG. 10, the backrest elastic force adjustment mechanism includes a rotary shaft 580 rotatably arranged on the chassis 500. The rotary shaft 580 may be arranged to be perpendicular to the screw 570, and the rotary shaft 580 and the screw 570 are meshed with each other via a bevel gear. One end, facing away from the screw 570, of the rotary shaft 580 is securely connected to another end, facing away from the rotation bar, of the flexible transmission shaft, such that when the rotation bar is rotated, a torque of the rotation bar is transmitted to the rotary shaft 580 via the flexible transmission shaft to drive the rotary shaft 580 to rotate, such that the screw 570 is caused to rotate to adjust the support position of the fulcrum structure 560 on the elastic sheet 550. In this way, the magnitude of the elastic force of the backrest is adjusted. It may be understood that in other embodiments, the backrest elastic force adjustment mechanism may be directly the screw 570. The flexible transmission shaft is directly connected to one end of the screw 570, such that in response to being rotated, the rotation bar directly drives, via the flexible transmission shaft, the screw 570 to rotate, such that the magnitude of the elastic force of the backrest is adjusted It should be noted that to reduce the size of the stop block 120, the seat adjustment module 100 is typically mounted on the junction between the support frame and the seating member frame. This results in that the twistable adjustment member 150 fails to be coaxially arranged with the backrest elastic force adjustment mechanism. By transmitting a torque of the twistable adjustment member 150 via the flexible transmission shaft to the backrest elastic force adjustment mechanism, the elastic force adjustment function of the backrest is implemented, but also no restriction is caused to the mounting position of the seat adjustment module 100.

In summary, in the seat adjustment module 100 according to the embodiments of the present disclosure, by integrating the stop block 120 on the base 110, it is ensured that the transmission member 131 driving the stop block 120 to slide has sound stability. By causing the rotary block 130 to rotate along two opposite directions, the function of adjusting forward and backward movements of the seating member and the function of adjusting the reclining angle of the backrest are implemented. By causing the handle 140 to rotate with respect to the rotary block 130, lift adjustment is achieved for the seat. In the meantime, the twistable adjustment member 150 is rotatably integrated on the base 110, and direction-variable driving on the backrest elastic force adjustment mechanism by the twistable adjustment member 150 is achieved via the flexible transmission member. In this way, the magnitude of the elastic force of the backrest is adjusted. The entire seat adjustment module 100 has a compact structure and has a high integration of functions. During use, the user may not feel be confused in adjustment functions, and thus user experience is greatly improved.

Figure 11:
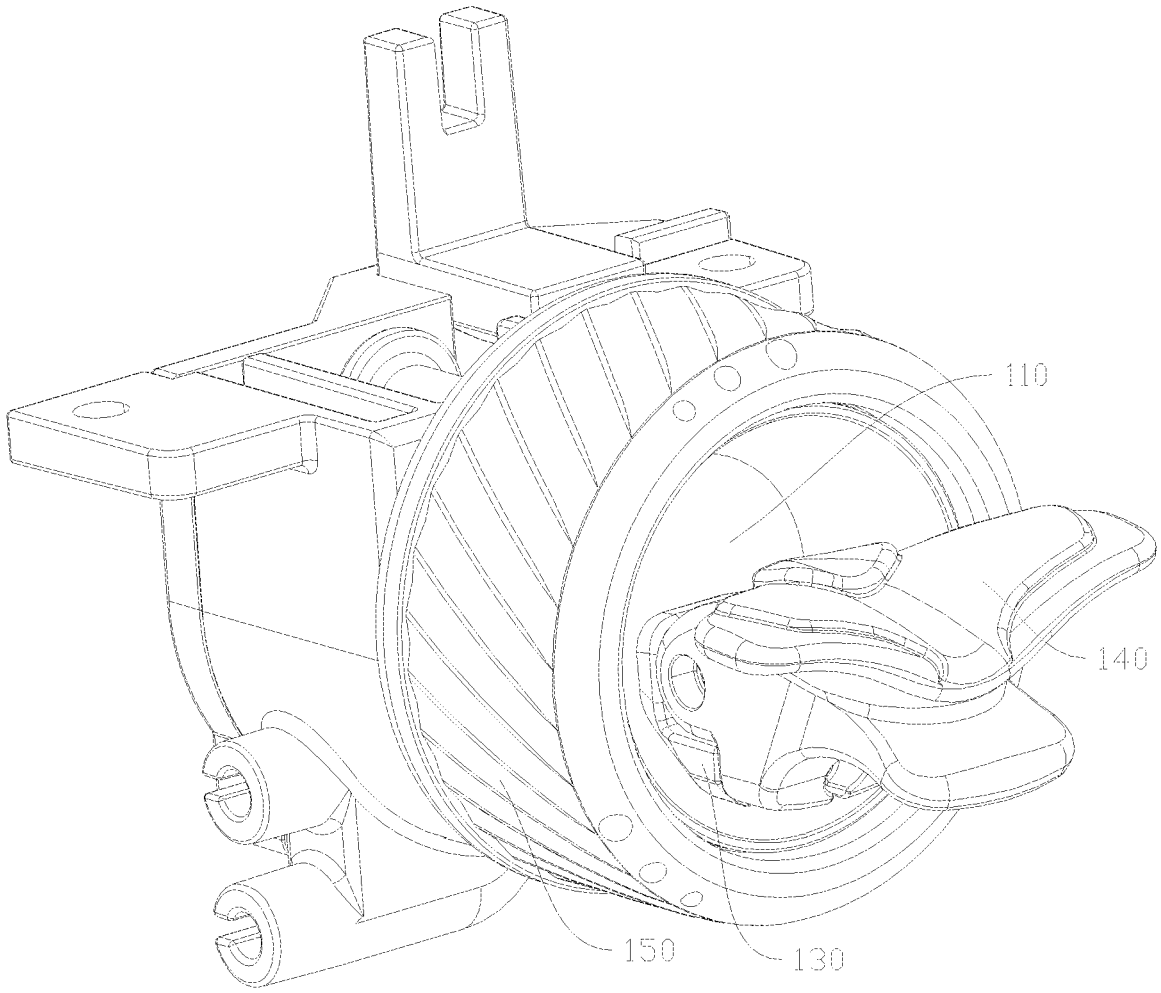
FIG. 11 is a schematic structural view of a seat adjustment module, taken from another view angle, according to an embodiment of the present disclosure.
Figure 12:
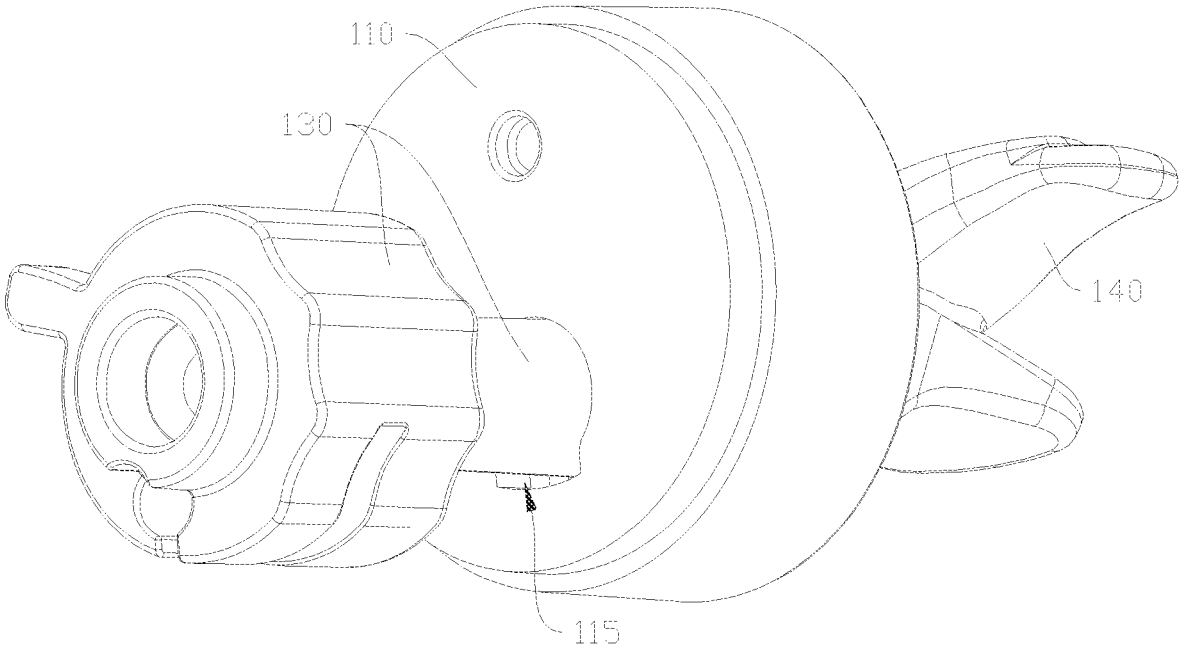
FIG. 12 is a schematic structural view of a junction of a base and a rotary block in a seat adjustment module according to an embodiment of the present disclosure.

To reduce the size of the seat adjustment module 100, the represent disclosure provides an example. Referring to FIG. 11 and FIG. 12, FIG. 11 illustrates a three-dimensional structure, taken from a view angle, of a seat adjustment module 100, and FIG. 12 illustrates a structure of a junction between the rotary block 130 and the base 110. As illustrated in FIG. 11 and FIG. 12, the rotary block 130 is arranged to run through the base 110, one end of the rotary block 130 is connected to the handle 140, and the twistable adjustment member 150 is situated on an outer circumference of the handle 140; and a through hole 115 configured to allow the second transmission rope (not illustrated) to travel through is arranged in the base 110. The through hole 115 is extended along the first rotation direction or the second rotation direction of the rotary block 130.

Figure 13:
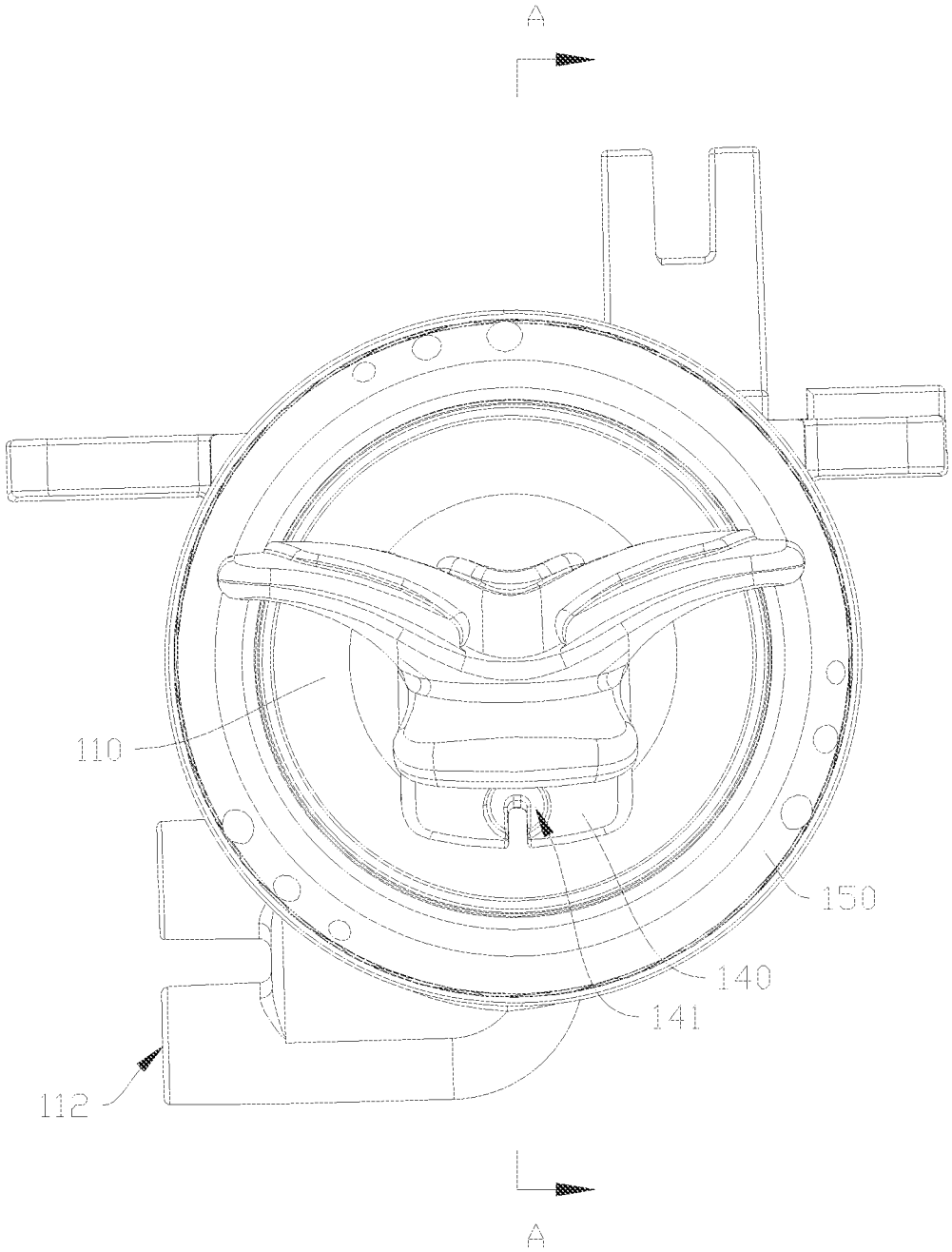
FIG. 13 is a schematic side structural view of a seat adjustment module according to an embodiment of the present disclosure.
Figure 14:
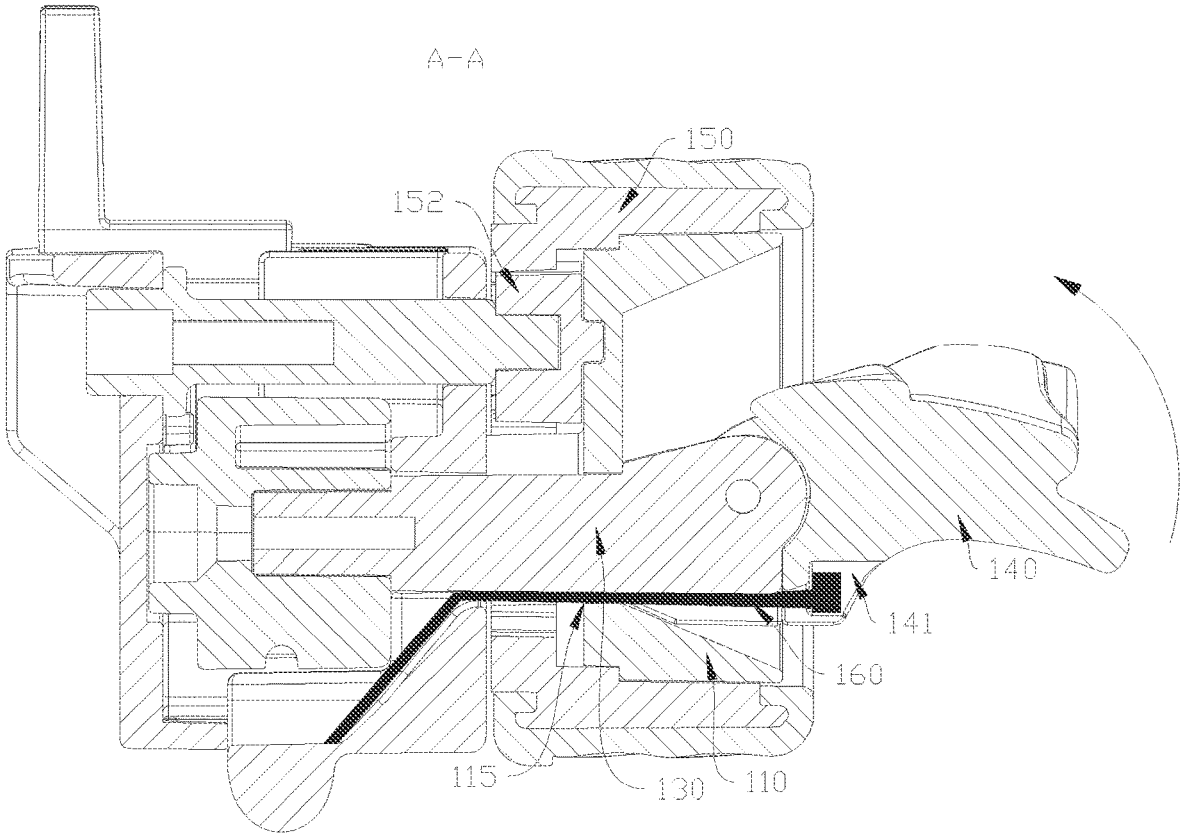
FIG. 14 is a schematic sectional structural view taken along an A-A line of the structure in FIG. 13.

Referring to FIG. 13 and FIG. 14, FIG. 13 illustrates a side structure of a seat adjustment module 100 according to an embodiment of the present disclosure, and FIG. 14 illustrates a sectional structure along an A-A line of FIG. 13. As illustrated in FIG. 13 and FIG. 14, one end of a second transmission rope 160 is secured to the second mounting recess 141 in the handle 140, is extended to travel through the through hole 115 in the base 110, and is led out via the second passing hole 112 as illustrated in FIG. 2 and FIG. 13 and is connected to the lifter switch. In response to being rotated and lifted along a direction indicated by an arrow in FIG. 14, the handle 140 drives the second transmission rope 160 to move, such that the lifter switch of the seat is opened. In this way, a height of the seating member is adjusted.

Still referring to FIG. 14, it should be noted that since the rotary block 130 is arranged to run through the base 110, the twistable adjustment member 150 is rotatably connected to the base 110 and is situated on the outer circumference of the handle 140, in the case of external routing, that is, the second transmission rope 160 is securely connected to the handle 140 and is routed outside the base 110 and the twistable adjustment member 150 and is connected to the lifter switch, not only neatness and aesthetics of the entire seat are affected, but also a pull force direction of the second transmission rope 160 fails to be conveniently controlled. As a result, it is difficult to timely and effectively open the lifter switch.

In view of the above problem, by arranging the through hole 115 allowing the second transmission rope 160 to travel through in the base 110, the second transmission rope 160 is partially shaded and hidden, the seat adjustment module 100 is maintained to be neat and aesthetic. In addition, the pull force direction of the second transmission rope 160 is restricted, and it is ensured that the adjustment function is timely responsive. Further, by arranging the twistable adjustment member 150 on the outer circumference of the handle 140, it is not only convenient for the user to grip the twistable adjustment member 150 for rotation adjustment, but also the entire structure and arrangement are optimized and the seat adjustment module 100 is entirely delicate and aesthetic.

To avoid the case where the lift adjustment function is enabled by mistake due to undesired pulling of the second transmission rope on the handle 140 when the user adjusts the forward and backward movements of the seating member or adjusts the backrest reclining angle by rotating the rotary block 130 via the handle 140, the through hole 115 is extended along the rotation direction of the rotary block 130, such that when the rotary block 130 is driven to rotate by rotating the handle 140 to adjust the forward and backward movements of the seating member and adjust the backrest reclining angle, the second transmission rope traveling through the through hole 115 is capable of swinging in the through hole 115 as rotation of the handle 140. In this way, the second transmission rope may not be subject to undesired and excessive pulling, and thus may not result in mis-opening of the lifter switch.

Figure 15:
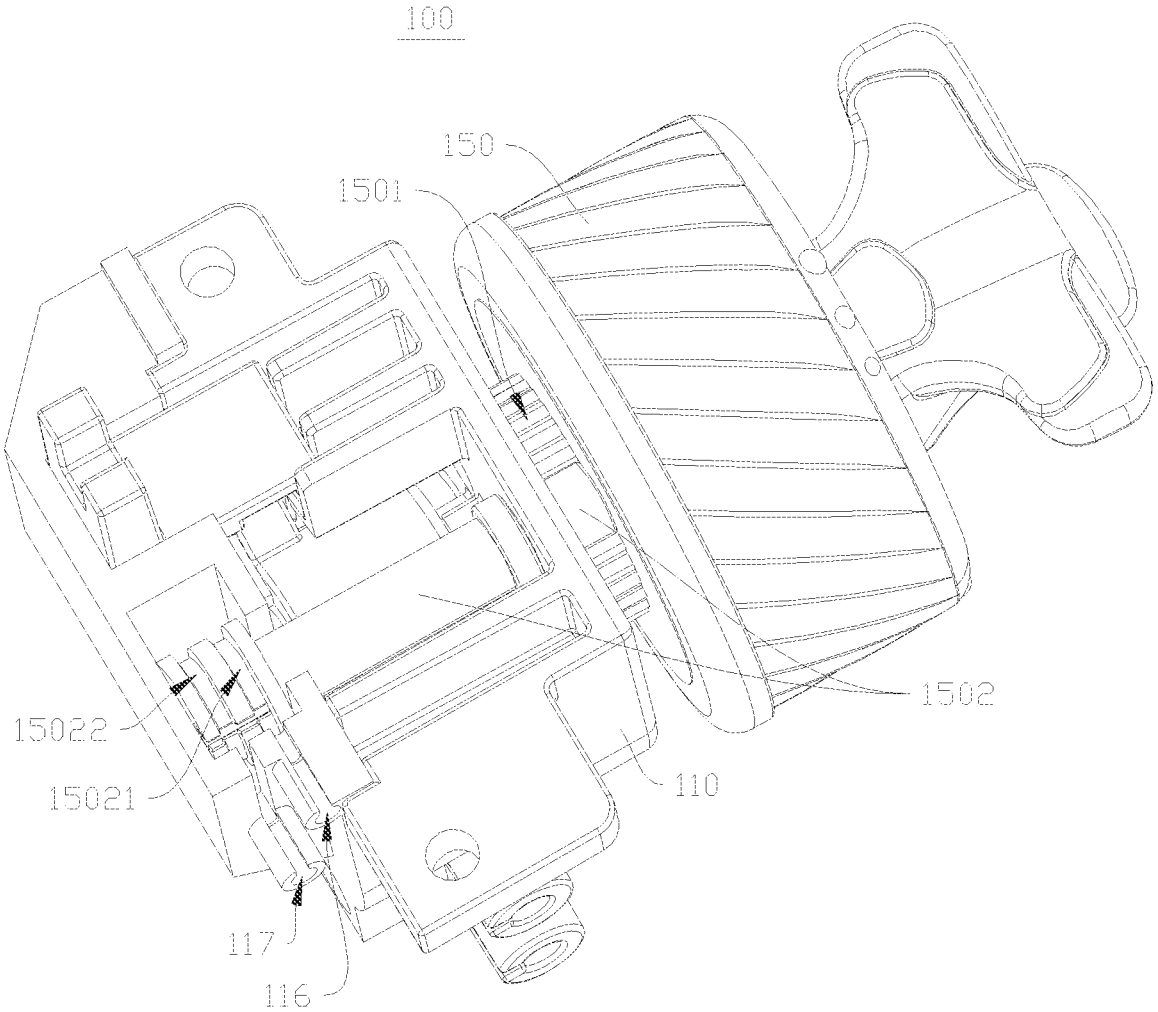
FIG. 15 is a schematic structural view of a seat adjustment module according to an embodiment of the present disclosure.

With respect to the structure of the twistable adjustment member 150, the present disclosure provides an example. Specifically, referring to FIG. 15, a structure of the seat adjustment module according to an embodiment of the present disclosure is illustrated. As illustrated in FIG. 15, a transmission structure 1501 is circumferentially arranged on the twistable adjustment member 150, and a driven wheel 1502 is rotatably arranged on the base 110. The driven wheel 1502 is transmissively engaged with the transmission structure 1501, and the flexible transmission member is connected to the driven wheel 1502.

Specifically, the transmission structure 1501 may be gear teeth circumferentially arranged on an outer wall of the twistable adjustment member 150, the driven wheel 1502 may be a gear, and the twistable adjustment member 150 is transmissively connected to the driven wheel 1502 via the gear teeth. The transmission structure 1501 may also be a belt engagement recess or a chain engagement recess, correspondingly the driven wheel 1502 may be a belt wheel or a chain wheel, and the twistable adjustment member 150 is transmissively connected to the driven wheel 1502 via a belt or a chain sleeved on the transmission structure 1501.

Figure 16:
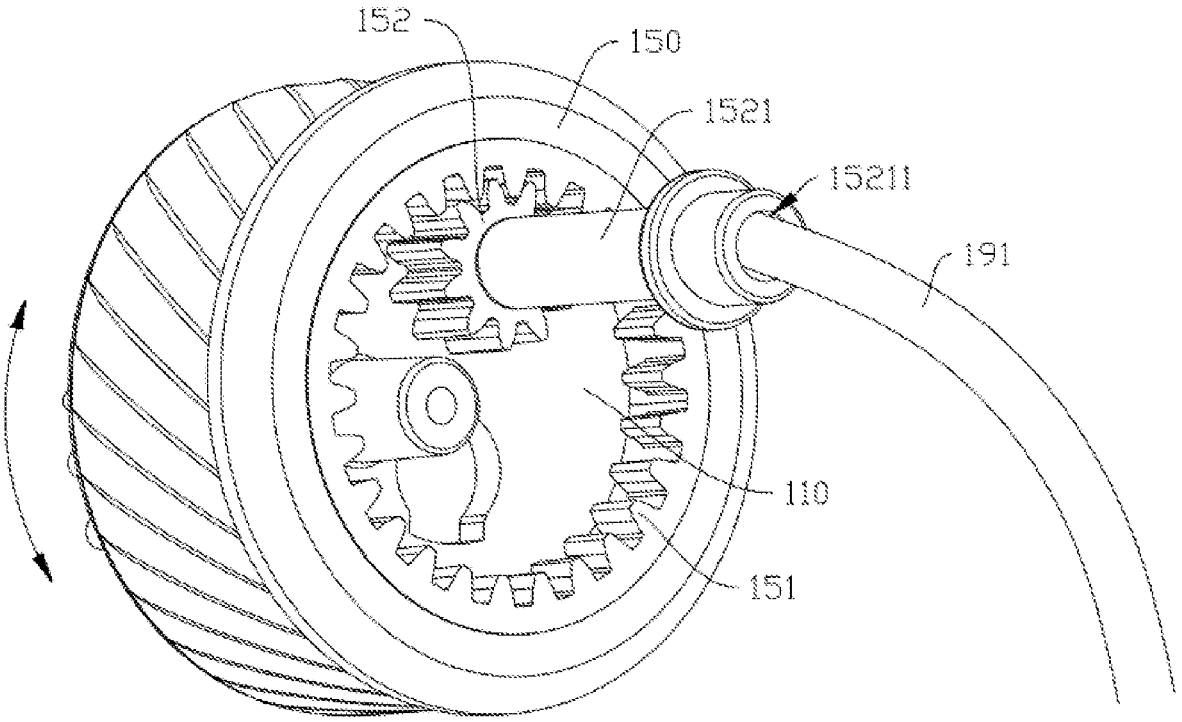
FIG. 16 is a schematic structural view of a twistable adjustment member in a seat adjustment module according to an embodiment of the present disclosure.

Referring to FIG. 16, a structure of a twistable adjustment member in a seat adjustment module according to another embodiment of the present disclosure is illustrated. In the specific embodiment as illustrated in FIG. 16, the transmission structure 1501 is a rack arranged circumferentially on an inner wall of the twistable adjustment member 150, and the driven wheel 1502 is a gear 152 in mesh with the rack.

By circumferentially arranging the transmission structure 1501 on the twistable adjustment member 150 and rotatably arranging the driven wheel 1502 in transmissive engagement with the transmission structure 1501 on the base 110, the driven wheel 1502 is flexibly arranged at any desired positions, such that avoidance between the driven wheel 1502 and the rotary block 130 is achieved and an overall structural arrangement of the seat adjustment module 100 is optimized.

Figure 17:
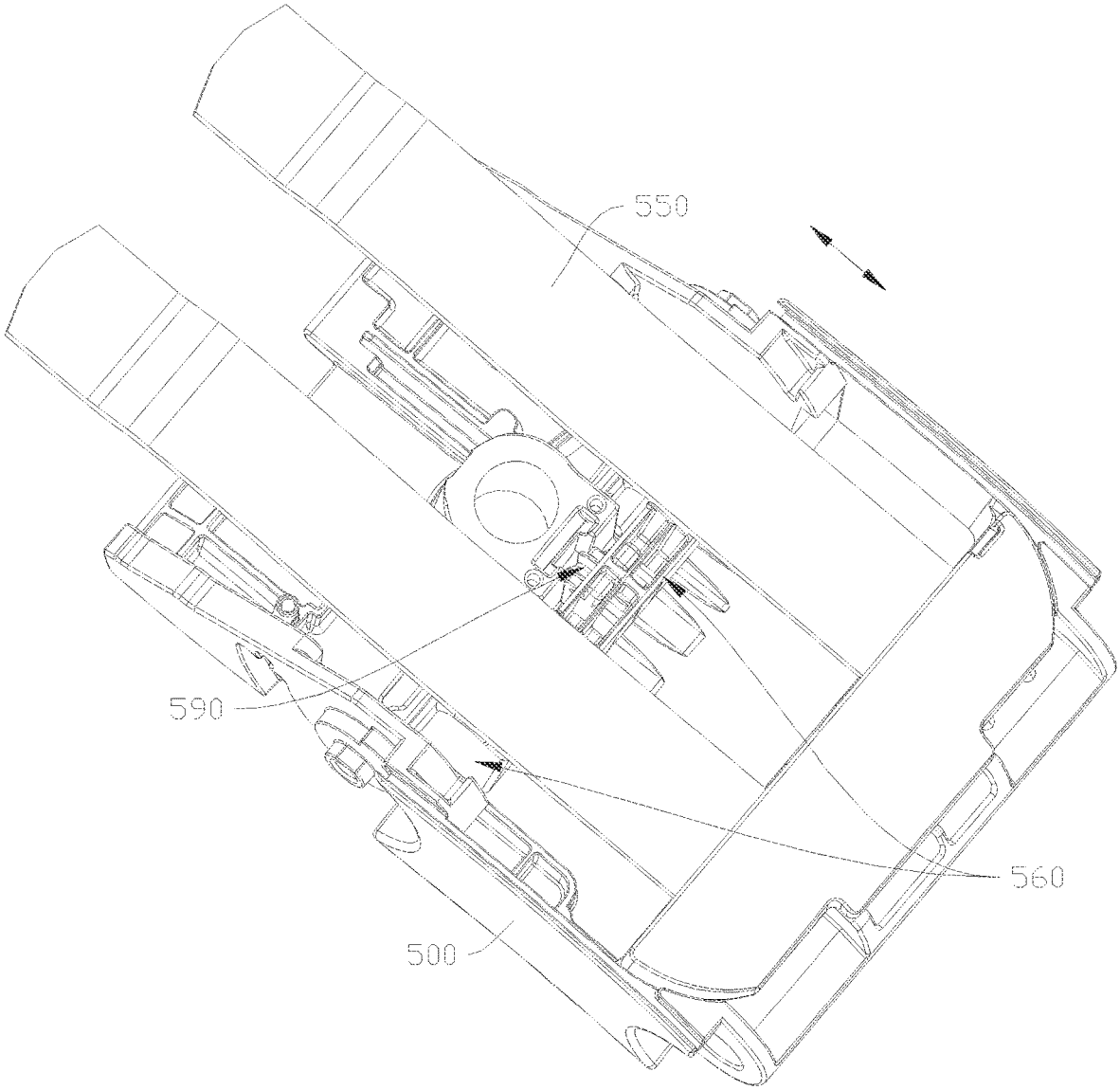
FIG. 17 is a schematic structural view of a chassis according to an embodiment of the present disclosure.
Figure 18:
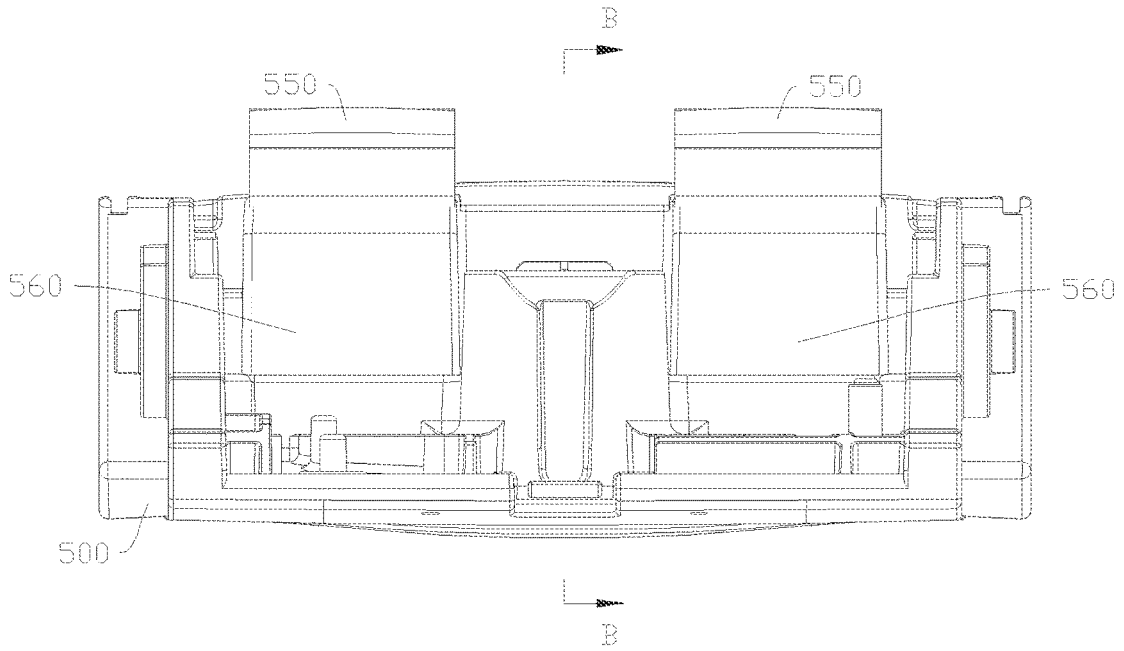
FIG. 18 is a schematic exploded structural view of a chassis, taken from a side view angle, according to an embodiment of the present disclosure.
Figure 19:
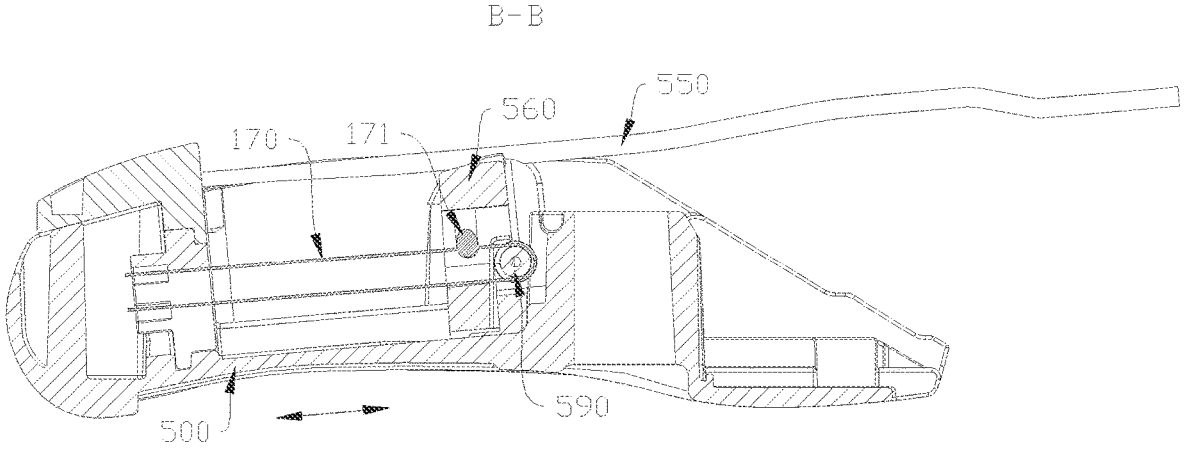
FIG. 19 is a schematic sectional view taken along a B-B line of the structure in FIG. 18.

With respect to the structure of the flexible transmission member, the present disclosure provides an example. Specifically, still referring to FIG. 15 and further referring to FIG. 17 to FIG. 19, FIG. 17 illustrates a structure of a chassis according to an embodiment of the present disclosure, FIG. 18 illustrates a side structure of a chassis, and FIG. 19 illustrates a sectional structure along a B-B line of the structure in FIG. 18. As illustrated in FIG. 17 to FIG. 19, the flexible transmission member includes a third transmission rope 170 (not illustrated in FIG. 19). Two ends of the third transmission rope 170 are wound and secured to the driven wheel 1502 along two opposite directions. The driven wheel 1502 is configured to be connected to the backrest elastic force adjustment mechanism via the third transmission rope 170. The twistable adjustment member 150 is configured to, in response to being rotated, drive, via the driven wheel 1502 and the third transmission rope 170, the backrest elastic force adjustment mechanism to move to adjust the magnitude of the elastic force of the backrest in the seat.

As illustrated in FIG. 15, a first passing slot 15021 and a second passing slot 15022 may be arranged in an extended end portion of the driven wheel 1502, a first leading hole 116 and a second leading hole 117 respectively corresponding to the first passing slot 15021 and the second passing slot 15022 may be arranged in the base 110, and two ends of the third transmission rope 170 are respectively led into the first leading hole 116 and the second leading hole 117 and are then wound and secured into the first passing slot 15021 and the second passing slot 15022.

In combination with FIG. 15, and FIG. 17 to FIG. 19, the backrest elastic force adjustment mechanism includes an elastic sheet 550, a fulcrum structure 560, and a tension mechanism 590 (for example, a tension wheel or a tension shaft or the like in the drawings), the elastic sheet 550 is connected between the chassis 500 and the backrest and is configured to supply a support elastic force to the backrest, the fulcrum structure 560 is slidably arranged on the chassis 500 along directions indicated by arrows in the drawings, the fulcrum structure 560 is supported at the bottom of the elastic sheet 550, and the tension mechanism 590 is rotatably arranged on the chassis 500. A middle section of the third transmission rope 170 travels through the fulcrum structure 560 and is wound on the tension mechanism 590. The third transmission rope 170 is securely connected to the fulcrum structure 560 via a fixed connection portion 171. When the twistable adjustment member 150 is rotated, the transmission structure 1501 on the twistable adjustment member 150 drives the driven wheel 1502 to rotate, such that the driven wheel 1502 drives the third transmission rope 170 to move. During movement, the third transmission rope 170 drives the fulcrum structure 560 to slide in the chassis 500 along the directions indicated by the arrows in the drawings, such that a support position of the fulcrum structure 560 on the elastic sheet 550 is altered and the magnitude of the elastic force of the backrest is adjusted.

With respect to the structure of the twistable adjustment member 150, the present disclosure provides an example. Specifically, still referring to FIG. 16, the flexible transmission member includes a flexible transmission shaft 191, and the driven wheel (the gear 152 as illustrated in FIG. 16) is configured to be connected to the backrest elastic force adjustment mechanism via the flexible transmission shaft 191. The twistable adjustment member 150 is configured to, in response to being rotated, drive, via the gear 152 and the flexible transmission shaft 191, the backrest elastic force adjustment mechanism to rotate to adjust the magnitude of the elastic force of the backrest in the seat.

Specifically, in the embodiment as illustrated in FIG. 16, one end of the gear 152 is securely connected to a mounting bar 1521, a third mounting recess 15211 is arranged in an end portion of the mounting bar 1521, one end of the flexible transmission shaft 191 is inserted and secured into the third mounting recess 15211, and another end of the flexible transmission shaft 191 is securely connected to the backrest elastic force adjustment mechanism. When the twistable adjustment member 150 is counterclockwise rotated along directions indicated by arrows in FIG. 16, the rack 151 on the inner wall thereof drives the gear 152 to rotate, and thus the gear 152 further a torque generated by rotation to the backrest elastic force adjustment mechanism via the flexible transmission shaft 191, such that the backrest elastic force adjustment mechanism is rotated. In this way, the support position (as illustrated in FIG. 9 and FIG. 10) of the fulcrum structure 560 on the elastic sheet 550 is adjusted, and eventually the magnitude of the elastic force of the backrest is adjusted. It may be understood that in some other embodiments, the flexible transmission shaft 191 may also be directly securely connected to one end of the gear 152.

In this way, a torque of the twistable adjustment member 150 is transmitted to the backrest elastic force adjustment mechanism via the flexible transmission shaft 191, such that the magnitude of the elastic force of the backrest is adjusted.

In some embodiments, the flexible transmission shaft 191 includes a soft shaft.

The soft shaft has a small rigidity and an elasticity and is capable of freely bendable and transmissive, and is configured to couple two parts that are not in the same axis, not in the same direction or having opposite movements. By a rotation movement and torque between the two parts, the soft shaft is capable of flexibly transmitting the rotation movement and torque to any position.

By transmitting the torque between the twistable adjustment member 150 and the backrest elastic force adjustment mechanism, a rotation axis of the twistable adjustment member 150 is flexibly arranged, but also torque transmission between the twistable adjustment member 150 and the backrest elastic force adjustment mechanism is ensured to be stable and reliable.

It may be understood that in some other embodiments, the flexible transmission shaft may employ a universal connection shaft, and the universal connection shaft is capable of likewise changing the axial direction and transmitting the torque.

With respect to the structure of the transmission member 131, the present disclosure further provides an example. Specifically, still referring to FIG. 2, a stop portion 121 is arranged at an end of the stop block 120 along a slide direction (directions indicated by up-down arrows in FIG. 2) thereof. The stop portion 121 is configured to be snap-fitted to the seating member to stop the forward and backward movements of the seating member. An abutment portion 122 is arranged at another end of the stop block 120 along the slide direction thereof. The transmission portion 131 is a lug arranged on a circumferential side wall of the rotary block 130. The rotary block 130 is configured to, in response to being rotated with respect to the base 110 along the first rotation direction (the direction indicated by the arrow a in FIG. 2), cause the lug to abut against the abutment portion 122 to drive the stop block 120 to slide, such that restrictions applied by the stop portion 121 on the forward and backward movements of the seating member are released.

Specifically, as illustrated in FIG. 2 and FIG. 5, when the rotary block 130 is rotated along the direction indicated by the arrow a, the lug is abutted against the abutment portion 122 and applies a force to the abutment portion 122 to drive the stop block 120 to move downward along directions indicated by arrows in the drawings, such that the stop portion 121 is disengaged from the slidable position portion 210 on the seating member frame 200. In this case, the user may move the seating member frame 200 along a front-rear direction to alter the position of the seat cushion.

By abutment between the lug and the abutment portion 122, the rotary block 130 drives the stop block 120 to move, such that the entire structure of the seat adjustment module 100 is compact, and the rotary block 130 is quick responsive to driving the stop block 120 in a stable and reliable fashion.

Figure 26:
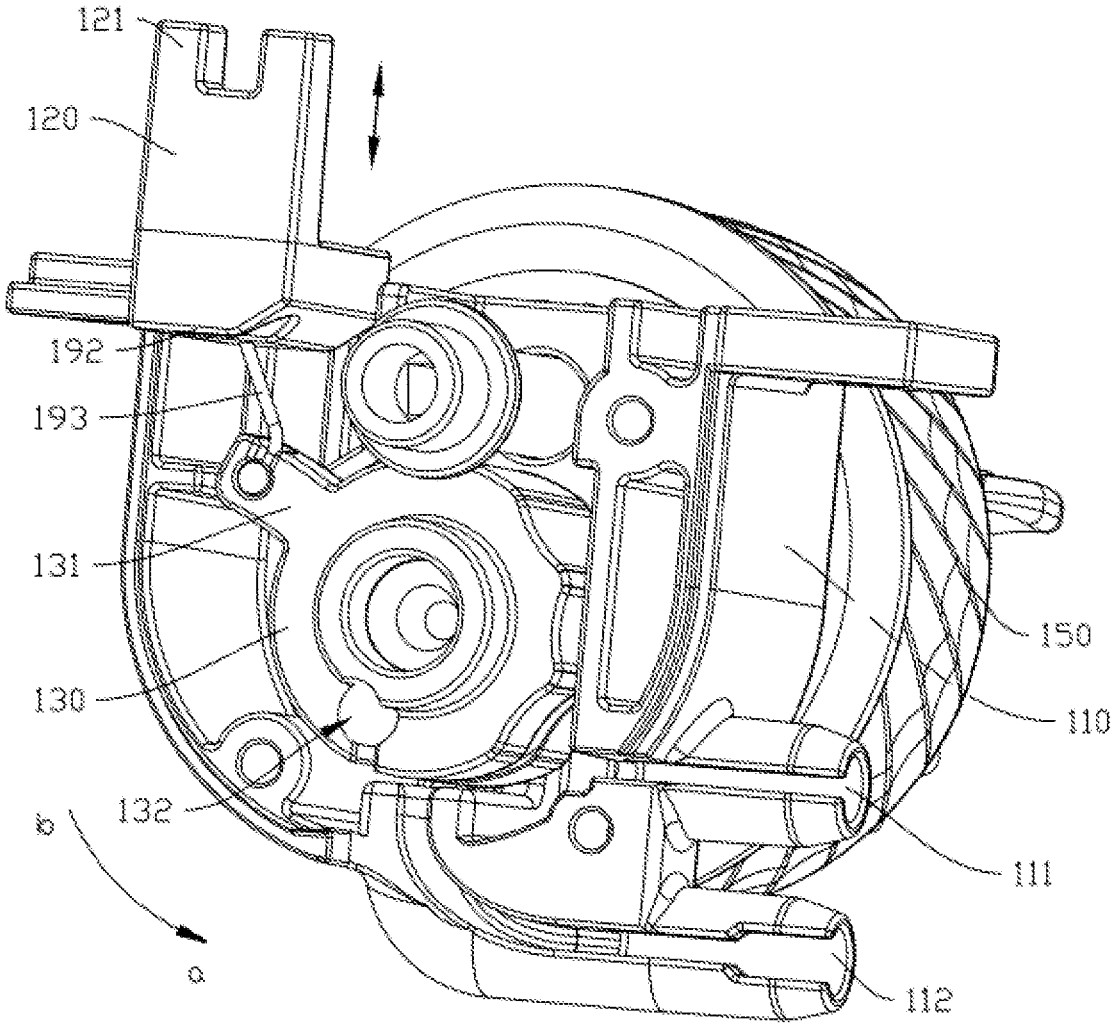
FIG. 26 is a schematic structural view of an interior of a seat adjustment module according to an embodiment of the present disclosure.
Figure 27:
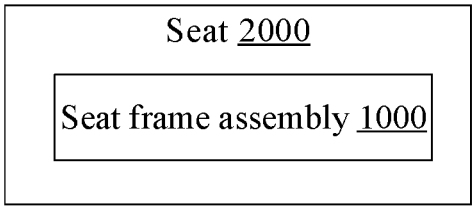
FIG. 27 is a schematic structural block view of a seat according to an embodiment of the present disclosure.

As illustrated in FIG. 26, with respect to the structure of the transmission portion 131, in some other embodiments, a connection portion 192 may also be arranged at another end the stop block 120 along the slide direction (the up-down directions indicated by the arrows in FIG. 2) thereof with respect to the stop portion 121. The transmission member is a fourth transmission rope 193 connected between the connection portion 192 and the rotary block 130. The rotary block 130 is configured to, in response to being rotated along the first rotation direction (the direction indicated by the arrow a in FIG. 2), pull the fourth transmission rope 193 to move to drive the stop block 120 to slide, such that restrictions applied by the stop block 120 on the forward and backward movements of the seating member are released.

It should be noted that the same principle applies for transmitting the pull force of the transmission block 130 on the stop block 120 by the fourth transmission rope 193 and transmitting the pull force of the rotary block 130 on the backrest adjustment switch by the first transmission rope 180, but directions of transmitting the forces are opposite. That is, when the rotary block 130 is rotated along the first rotation direction (the direction indicated by the arrow a in FIG. 2), the fourth transmission rope 193 pulls the stop block 120 to slide; and when the rotary block 130 is rotated along a second rotation direction (a direction indicated by an arrow b in FIG. 2), the first transmission rope 180 pulls the backrest adjustment switch to be opened.

With respect to the fashion of pulling the stop block 120 by the fourth transmission rope 193, the rotary block 130 does not need to be rigidly abutted against the stop block 120. Therefore, a relative position between the rotary block 130 and the stop block 120 may be flexibly adjusted, such that it is convenient to optimize the overall arrangement of the structure.

With respect to the embodiments where the transmission member 131 employs a lug, to prevent slide interference to the stop block 120 during adjusting the reclining angle of the backrest, the present disclosure further provides an example. Specifically, still referring to FIG. 2, a strip-shaped opening 1221 extending along the slide direction (the directions indicated by the up-down arrows in FIG. 2) of the stop block 120 is arranged in the abutment portion 122. The lug is configured to, in response to the rotary block 130 being rotated along the first rotation direction (the direction indicated by the arrow a in FIG. 2) with respect to the base 110, be abutted against an inner wall at one end of the strip-shaped opening 1221 to drive the stop block 120 to slide. The lug is further configured to, in response to the rotary block 130 being rotated along the second rotation direction (the direction indicated by the arrow b in FIG. 2) with respect to the base 110, move in the strip-shaped opening 1221 and be not in structural interference with the abutment portion 122.

As illustrated in FIG. 2, the strip-shaped opening 1221 extending along the directions indicated by the up-down arrows in FIG. 2 is arranged in the abutment portion 122, and when the rotary block 130 is rotated along the direction indicated by the arrow a, the lug is abutted against a lower end of the strip-shaped opening 1221 to drive the stop block 120 to move downward, such that the forward and backward movements of the seating member are released. However, when the rotary block 130 is rotated along the direction indicated by the arrow b to adjust the reclining angle of the backrest, the lug may slide in the strip-shaped opening 1221 and may not be in structural interference with the abutment portion 122, such that the lug may not drive the stop block 120 to slide. In this way, while the function of adjusting the reclining angle of the backrest is implemented, no interference is caused to sliding of the stop block 120, such that reclining angle adjustment of the backrest and forward and backward movements adjustment of the seating member are achieved independently without any mutual interference.

Figure 20:
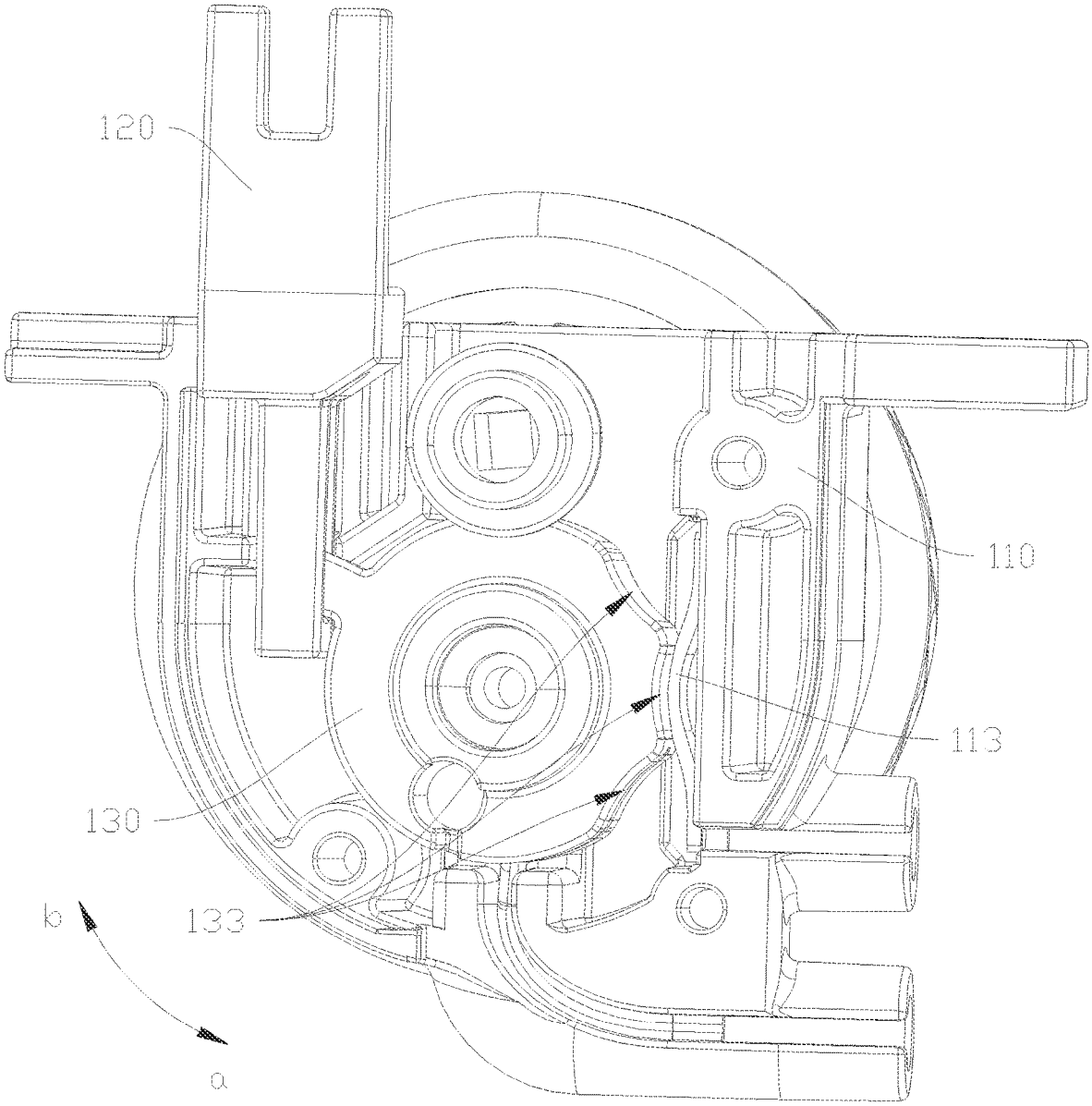
FIG. 20 is a schematic side structural view of an interior of a seat adjustment module according to an embodiment of the present disclosure.

To save manpower of the user in adjustment by rotating the rotary block 130, the present disclosure provides an example. Specifically, referring to FIG. 20, an internal structure of a seat adjustment module is illustrated. As illustrated in FIG. 20, a plurality of position engagement portions 133 are arranged on a side wall of the rotary block 130, and an engagement member 113 is arranged on the base 110. The engagement member 113 is configured to be engaged with different position engagement portions 133 in response to the rotary block 130 being rotated.

In the specific embodiment as illustrated in FIG. 20, the position engagement portions 133 are arc-shaped slots arranged in the circumferential side wall of the rotary block 130, and the engagement member 113 is an arc-shaped elastic sheet secured on the base 110. By snap-fit engagement between the engagement member 113 and the different position engagement portions 133, the rotary block 130 is capable of being rotated to different angles and then being secured. During the forward and backward movements adjustment of the seating member and the reclining angle adjustment of the backrest, when the user rotates the rotary block 130 to a corresponding angle, the engagement member 113 is snap-fitted to the corresponding position engagement portion 133, such that the rotary block 130 is secured at the angle. In this case, the user does not need to apply a torque to the rotary block 130, and only conduct corresponding adjustment. Upon proper adjustment, the user then reversely rotates the rotary block 130 to cause the rotary block 130 to returns its original position, and till now the adjustment of the corresponding functions is completed. Accordingly, the entire process is convenient and labor-saving, and during this process, the user does not need to continuously apply a force to the rotary block 130 to maintain the corresponding adjustment structure to be active.

Still referring to FIG. 20, in the specific embodiment as illustrated in FIG. 20, the number of position engagement portions 133 is three, and the three position engagement portions 133 are arranged along an axial direction of the rotary block 130. When the rotary block 130 is in an initial state (that is, a state where the adjustment function is not available), the engagement member 113 is in snap-fit engagement with a middle position engagement portion 133, such that the rotary block 130 is maintained at an angle to prevent the rotary block 130 is prevented from mis-rotation. When the rotary block 130 is rotated properly along the direction indicated by the arrow a in FIG. 20, the engagement member 113 is a lowest position engagement portion 133 in FIG. 20, such that the rotary block 130 is maintained at the angle and secured there. In this case, the forward and backward movements of the seating member are adjusted. When the rotary block 130 is rotated properly along the direction indicated by the arrow b in FIG. 20, the engagement member 113 is an upper position engagement portion 133 in FIG. 20, such that the rotary block 130 is maintained at the angle and secured there. In this case, the reclining angle of the backrest is adjusted.

Figure 21:
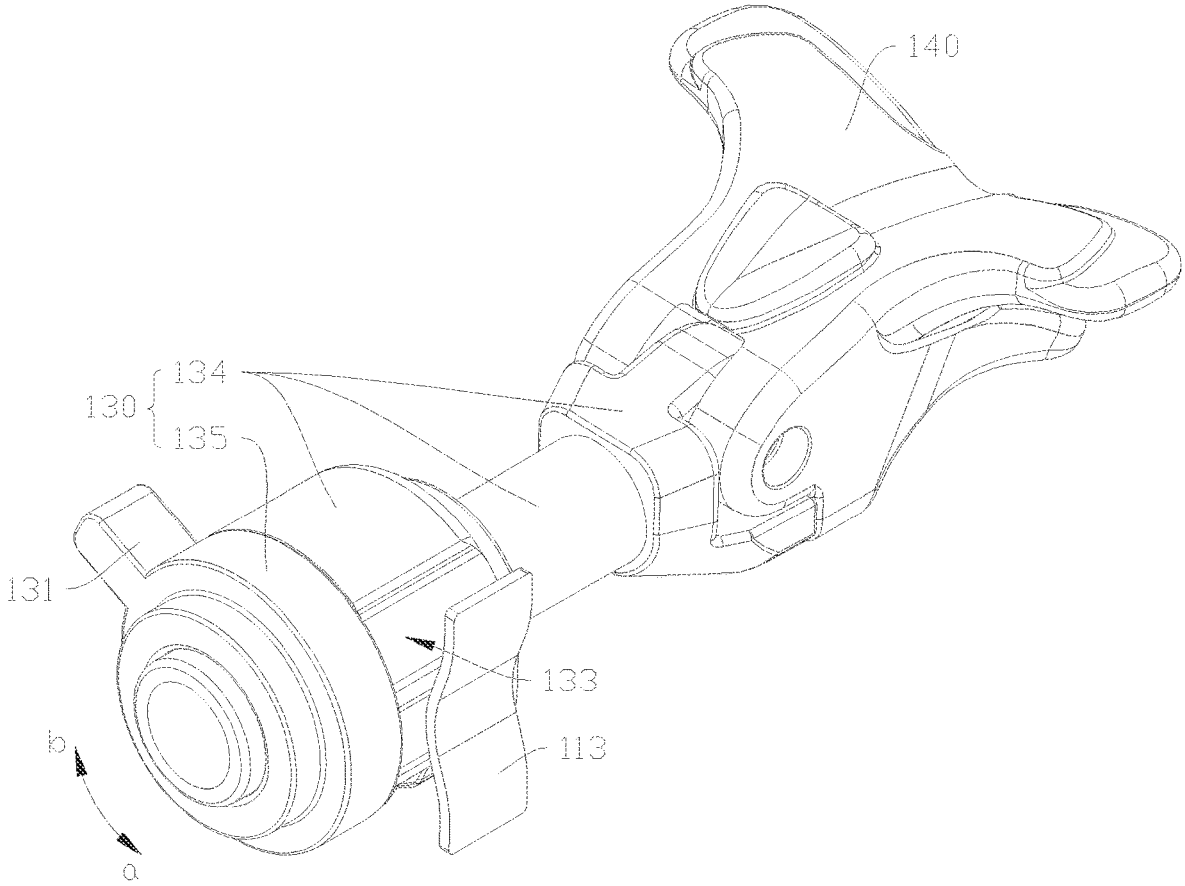
FIG. 21 is a schematic structural view of a rotary block and a handle in a seat adjustment module according to an embodiment of the present disclosure.
Figure 22:
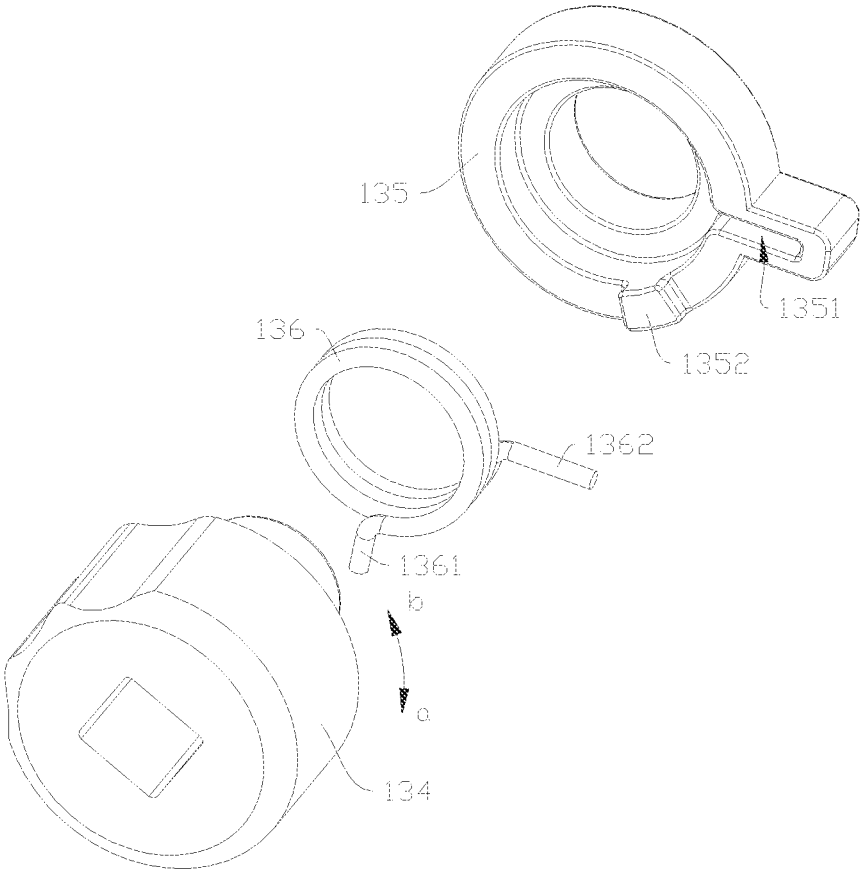
FIG. 22 is a schematic exploded structural view of a rotary block, taken from a view angle of a first body and a second body, in a seat adjustment module according to an embodiment of the present disclosure.
Figure 23:
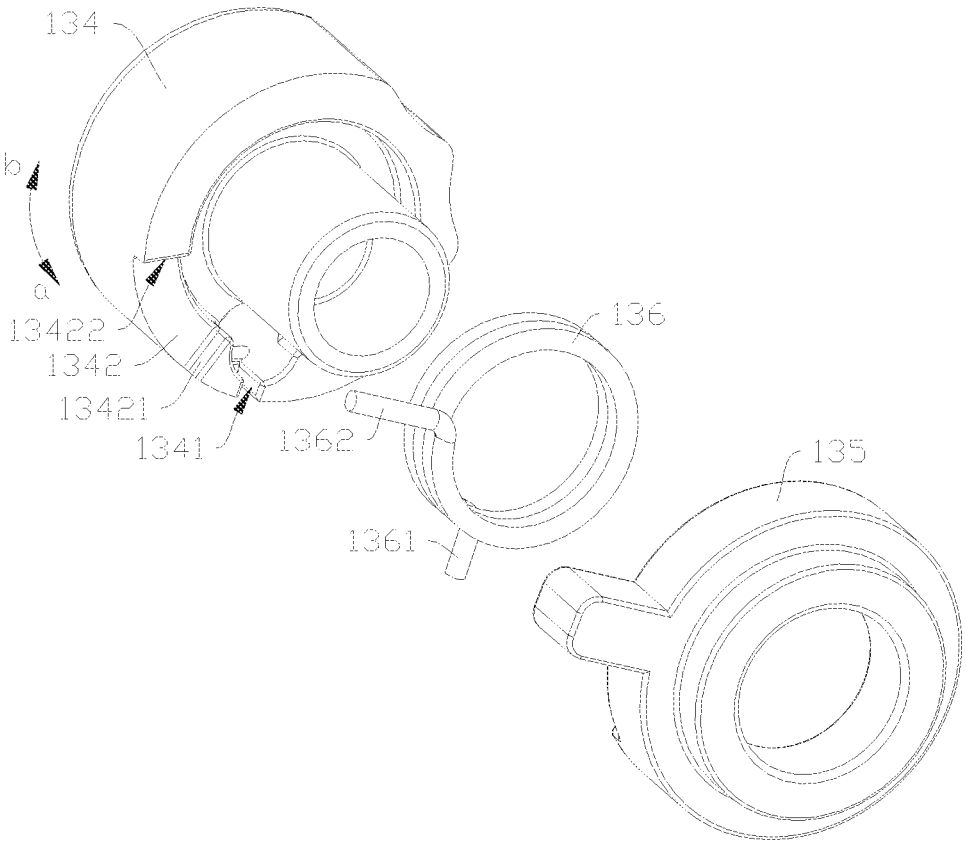
FIG. 23 is a schematic exploded structural view of a rotary block, taken from another view angle of a first body and a second body, in a seat adjustment module according to an embodiment of the present disclosure.

Typically, the user adjusts the corresponding functions while seated in the seating member. In this case, the stop block 120 is in dead-lock with the position engagement portion on the seating member frame, and the rotary block 130 cannot be rotated. To prevent this situation, the present disclosure provides an example. Specifically, referring to FIG. 21, a structure of a rotary block according to an embodiment of the present disclosure is illustrated. As illustrated in FIG. 21, the rotary block 130 includes a first body 134 and a second body 135. The first body 134 is connected between the handle 140 and the second body 135. Referring to FIG. 22 and FIG. 23, exploded structural views of the first body and the second body from two view angles are respectively illustrated. As illustrated in FIG. 22 and FIG. 23, a torsional elastic member 136 is connected between the first body 134 and the second body 135. The second body 135 is configured to drive, via the transmission member 131, the stop block 120 to slide.

In combination with FIG. 21 to FIG. 23, the torsional elastic member 136 may employ a torsional spring, a first stress end 1361 of the torsional elastic member 136 is snap-fitted to a first engagement recess 1341 in the first body 134, and a second stress end 1362 is snap-fitted to a second engagement recess 1351 in the second body 135. When the user is seated on the seating member, the stop block 120 is in dead-lock with a slidable position portion on the seating member frame. In this situation, when the user drives, via the handle 140, the first body 134 of the rotary block 130 to rotate along the direction indicated by the arrow a in the drawings, the first body 134 is capable of being normally rotated and driving the first stress end 1361 to rotate. In this case, the second body 135 cannot be rotated because the stop block 120 is in dead-lock with the slidable position portion on the seating member frame. Therefore, at this moment, the torsional elastic member 136 itself has an elastic force to resume from deformation. Afterwards, when the user moves his or her hip or leg on the seating member, dead-lock between the stop block 120 and the slidable position portion on the seating member frame is released, such that the second stress end 1362 of the torsional elastic member 136 resumes from deformation and is rotated to drive the second body 135 to rotate. Hence, the second body 135 drives, via the transmission member 131, the stop block 120 to slide, such that the stop block 120 is disengaged and from the slidable position portion on the seating member frame and dead-lock is released.

To prevent the case where when the second body 135 cannot be rotated, the torsional elastic member 136 is excessively twisted and thus damaged because the first body 134 is excessively rotated, the present disclosure further provides an example. Specifically, still referring to FIG. 22 and FIG. 23, the first body 134 and the second body 135 are engaged with each other via a stop sliding block 1352 and a stop chute 1342. The stop sliding block 1352 and the stop chute 1342 are slidably engaged with each other to restrict a maximum stroke of relative rotation between the first body 134 and the second body 135.

Specifically, in the specific embodiment as illustrated in FIG. 22 and FIG. 23, the stop sliding block 1352 is arranged on the second body 135, and the stop chute 1342 is arranged in the first body 134. Nevertheless, in other embodiments, the stop sliding block 1352 is arranged on the first body 134, and the stop chute 1342 is arranged in the second body 135. In the initial state (that is, a state where the adjustment function is not available), the stop sliding block 1352 is abutted against a first abutment inner surface 13421 of the stop chute 1342 facing the direction indicated by the arrow b. When the reclining angle of the backrest needs to be adjusted, the first body 134 is rotated along the direction indicated by the arrow b in the drawings. In this case, the first abutment inner wall 13421 directly applies a force to the stop sliding block 1352, such that the second body 135 is rotated with the first body 134 to hence pull the first transmission rope (not illustrated) to open the backrest adjustment switch. With respect to the case where the backrest adjustment switch is in dead-lock and the rotary block 130 cannot be rotated for adjustment, description has been made in the embodiment as illustrated in FIG. 6. Therefore, when the first body 134 is rotated along the direction indicated by the arrow b in the drawings and hence drives the second body 135 to rotate as well for adjustment of the reclining angle of the backrest, the torsional elastic member 136 may not transmit a torque between the two bodies, but the stop sliding block 1352 is directly driven to rotate via the first abutment inner wall 13421 in the stop chute 1342 in the first body 134.

Where the second body 135 cannot be rotated along the direction indicated by the arrow a in the drawings due to dead-lock of the stop block 120, for adjustment of the forward and backward movements of the seating member, the first body 134 is first rotated along the direction indicated by the arrow a. In this case, the stop chute 1342 may be rotated with the first body 134 along the direction indicated by the arrow a, such that the stop sliding block 1352 slides in the stop chute 1342 along the direction indicated by the arrow b in the drawings with respect to the stop chute 1342. When the first body 134 is rotated to its maximum stroke, the stop sliding block 1352 may be abutted against a second abutment inner wall 13422 facing the direction indicated by the arrow a in the stop chute 1342, such that the first body 134 fails to continuously moving along the direction indicated by the arrow a.

The first body 134 and the second body 135 are engaged with each other via the stop sliding block 1352 and the stop chute 1342 to restrict the maximum stroke of relative rotation between the two bodies, such that it is ensured that the first body 134 is only capable of being rotated to the maximum stroke along the first rotation direction (that is, the direction indicated by the arrow a in FIG. 22 and FIG. 23) when the second body 135 cannot be rotated due to dead-lock of the stop block 120. In this way, the first body 134 may not drive the torsional elastic member 136 to excessively rotate. This effectively ensures that the torsional elastic member 136 is structurally stable, and ensures that the function of adjusting the forward and backward movements of the seating member is stably and reliably implemented.

For automatic restoration of the stop block 120, in some embodiments, a restoration elastic member is arranged between the stop block 120 and the base 110. The restoration elastic member is configured to apply a restoration elastic force to the stop block 120, such that the stop block 120 is automatically restored and engaged with the seating member when no force supplied is applied by the rotary block 130.

Figure 24:
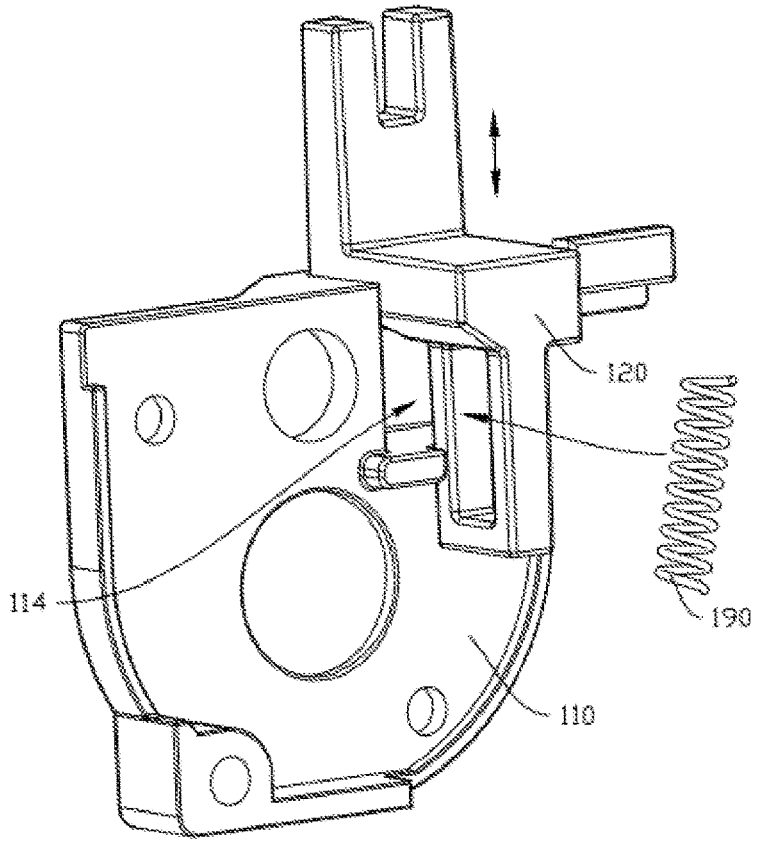
FIG. 24 is a schematic structural view of a part of a base and a stop block in a seat adjustment module according to an embodiment of the present disclosure.

The restoration elastic member may employ a compressive spring, an elastic member or the like, for example, a compressive spring 190 as illustrated in the drawings. Specifically, referring to FIG. 24, a structure of a stop block and part of a base is illustrated. In the specific embodiment as illustrated in FIG. 24, an accommodation recess 114 is arranged in the base 110. The restoration elastic member (not illustrated) is arranged in the accommodation recess 114, and the restoration elastic member is abutted against both an inner wall of the accommodation recess 114 and the stop block 120, such that the restoration elastic member supplies a restoration elastic force to the stop block 120 for an upward movement thereof along directions indicated by arrows in FIG. 24.

Figure 25:
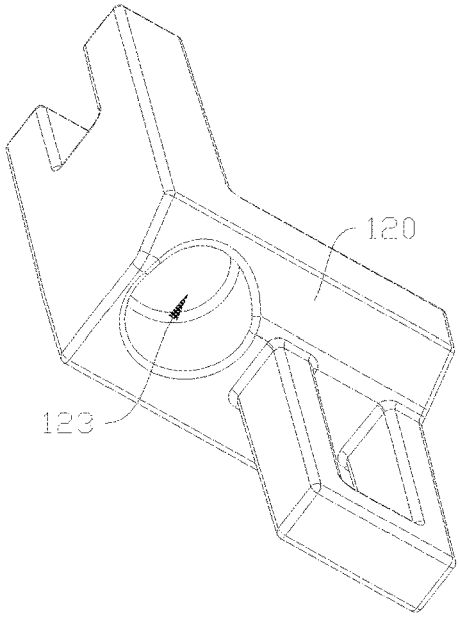
FIG. 25 is a schematic structural view of a stop block in a seat adjustment module according to an embodiment of the present disclosure.

Further, referring to FIG. 25, a structure of a stop block is illustrated. As illustrated in FIG. 25, to ensure stability of the restoration elastic member, a stop recess 123 may be arranged in the stop block 120. One end of the restoration elastic member extends into the stop recess 123 and is abutted against an inner wall of the stop recess 123 to supply an elastic force to the stop block 120. By stopping the restoration elastic member by the stop recess 123, it is ensured that the restoration elastic member is placed at a current position and has a stable structure, such that the stop block 120 is timely and effectively restored.

According to another aspect of the embodiments of the present disclosure, a seat frame assembly is provided. Specifically, still referring to FIG. 7, a seat frame assembly 1000 includes: a frame 1100 and the seat adjustment module 100 as described in any of the above embodiments.

In the seat frame assembly 1000 according to the embodiments of the present disclosure, with the seat adjustment module 100 integrating a variety of functions, during use, the user may not be confused in adjustment functions, which is conducive to improving user experience. In addition, the seat adjustment module 100 has a compact structure and a small size, which is conducive to improving neatness and aesthetics of the seat frame assembly 1000.

Still referring to FIG. 7, in some embodiments, the frame 1100 includes a support frame 300 and a seating member frame 200. The seating member frame 200 is slidably connected to the support frame 300 along a front-rear direction (directions indicated by arrows in FIG. 7), and the seat adjustment module 100 is situated at a junction between the support frame 300 and the seating member frame 200. Still referring to FIG. 5, a slidable position portion 210 is arranged on the seating member frame 200. The stop block 120 is in snap-fit engagement with the slidable position portion 210.

Still referring to FIG. 7 and in further combination with FIG. 9 and FIG. 10, in some embodiments, the frame 1100 includes a backrest 400, a chassis 500 is arranged on the support frame 300, and an elastic sheet 550 is arranged between the chassis 500 and the backrest 400. A fulcrum structure 560 is slidably arranged on the chassis 500. The fulcrum structure 560 is abutted against the elastic sheet 550, such that the elastic sheet 550 supplies a support elastic force to the backrest 400. A rotatable adjustment member (for example, the screw 570 as illustrated in FIG. 10) is connected to the fulcrum structure 560, and the flexible transmission member includes a flexible transmission shaft (not illustrated). The flexible transmission shaft is connected to the rotatable adjustment member. The twistable adjustment member 150 is configured to, in response to being rotated, drive, via the flexible transmission shaft, the rotatable adjustment member to rotate, such that the fulcrum structure 560 slides with respect to the chassis 500 to alter a magnitude of the support elastic force supplied by the elastic sheet 550 to the backrest 400.

It may be understood that the flexible transmission shaft may be directly securely connected to one end of the rotatable adjustment member (for example, the screw 570 as illustrated in FIG. 10), or may be connected to one end of the rotation shat 580 as illustrated in FIG. 10, and may be subsequently transmissively connected to the rotatable adjustment member by means of a bevel gear via the rotary shaft 580. In this way, the flexible transmission shaft is transmissively connected to the rotatable adjustment member.

Referring to FIG. 17 to FIG. 19, in some other embodiments, a tension mechanism 590 is arranged on the chassis 500. The flexible transmission shaft includes a third transmission rope 170. Two ends of the third transmission rope are wound and secured to the twistable adjustment member 150 along two opposite directions, and the third transmission rope 170 is securely connected to the fulcrum structure 560. The twistable adjustment member 150 is configured to, in response to being rotated, drive, via the third transmission rope 170, the fulcrum structure 560 to slide with respect to the chassis 500 (along directions indicated by arrows in FIG. 17 and FIG. 19), to alter the magnitude of the support elastic force supplied by the elastic sheet 550 to the backrest 400.

When the seat adjustment module 100 is arranged at the junction between the support frame 300 and the seating member frame 200, the twistable adjustment member 150 is far away from the backrest elastic force adjustment mechanism, and transmission relationships are complex. Therefore, the flexible transmission shaft and the rotatable adjustment member are in transmissive engagement with each other or the third transmission rope 170 drives the fulcrum structure 560 to move, such that when the twistable adjustment member 150 is rotated, the fulcrum structure 560 is capable of being rotated, and hence the magnitude of the elastic force of the backrest is adjusted.

Still referring to FIG. 9, in some embodiments, the magnitude of the elastic force of the backrest 400 is determined by the single elastic 550 arranged between the chassis 500 and the backrest 400.

By supplying the elastic force to the backrest 400 using the single elastic sheet 550, a suitable elastic force is ensured, and meanwhile materials are saved, and product costs are lowered.

According to still another aspect of the embodiments of the present disclosure, a seat 2000 is provided. The seat 2000 includes the seat frame assembly 1000 as described in any one of the above embodiments.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope of the present disclosure. Especially, various technical features mentioned in various embodiments may be combined in any fashion as long as there is no structural conflict.

What is claimed is:

1. A seat adjustment module, comprising:

a base;

a stop block, slidably connected to the base, and configured to stop forward and backward movements of a seating member in a seat;

a rotary block, rotatably connected to the base, and configured to, in response to being rotated along a first rotation direction, drive the stop block to slide by a transmission member to release restrictions applied by the stop block on the forward and backward movements of the seating member, wherein the rotary block is further configured to, in response to being rotated along a second rotation direction, pull a first transmission rope to move to open a backrest adjustment switch in the seat, the second rotation direction being opposite to the first rotation direction;

a handle, rotatably connected to one end of the rotary block, and configured to, in response to being rotated with respect to the rotary block, pull a second transmission rope to move to open a lifter switch of the seat; and a twistable adjustment member, rotatably connected to the base, and configured to be connected to a backrest elastic force adjustment mechanism by a flexible transmission member, wherein the twistable adjustment member is configured to, in response to being rotated, adjust a magnitude of an elastic force of a backrest in the seat by the flexible transmission member.

2. The seat adjustment module according to claim 1, wherein the rotary block is arranged to run through the base, one end of the rotary block is connected to the handle, and the twistable adjustment member is situated on an outer circumference of the handle; and a through hole configured to allow the second transmission rope to travel through is arranged in the base, the through hole being extended along the first rotation direction or the second rotation direction of the rotary block.

3. The seat adjustment module according to claim 1, wherein a transmission structure is circumferentially arranged on the twistable adjustment member, and a driven wheel is rotatably arranged on the base, wherein the driven wheel is transmissively engaged with the transmission structure, and the flexible transmission member is connected to the driven wheel.

4. The seat adjustment module according to claim 3, wherein the flexible transmission member comprises a third transmission rope, wherein two ends of the third transmission rope are wound and secured to the driven wheel along opposite directions, the driven wheel is configured to be connected to the backrest elastic force adjustment mechanism by the third transmission rope, and the twistable adjustment member is configured to, in response to being rotated, drive, via the driven wheel and the third transmission rope, the backrest elastic force adjustment mechanism to move to adjust the magnitude of the elastic force of the backrest in the seat; or the flexible transmission member comprises a flexible transmission shaft, wherein the driven wheel is configured to be connected to the backrest elastic force adjustment mechanism by the flexible transmission shaft, and the twistable adjustment member is configured to, in response to being rotated, drive, via the driven wheel and the flexible transmission shaft, the backrest elastic force adjustment mechanism to move to adjust the magnitude of the elastic force of the backrest in the seat.

5. The seat adjustment module according to claim 4, wherein the flexible transmission shaft comprises a flexible shaft.

6. The seat adjustment module according to claim 1, wherein a stop portion thereof is arranged at a first end of the stop block along a slide direction, wherein the stop portion is configured to be engaged with the seating member to stop the forward and backward movements of the seating member; and an abutment portion is arranged at a second end of the stop block along the slide direction thereof, wherein the transmission member is a lug arranged on a circumferential side wall of the rotary block, the rotary block is configured to, in response to being rotated with respect to the base along the first rotation direction, cause the lug to abut against the abutment portion to drive the stop block to slide such that restrictions applied by the stop block on the forward and backward movements of the seating member are released; and/or a connecting portion is arranged at the second end of the stop block along the slide direction thereof, wherein the transmission member is a fourth transmission rope connected between the connecting portion and the rotary block, the rotary block is configured to, in response to being rotated with respect to the base along the first rotation direction, pull the fourth transmission rope to move to drive the stop block to slide such that restrictions applied by the stop block on the forward and backward movements of the seating member are released.

7. The seat adjustment module according to claim 6, wherein a strip-shaped opening extending along the slide direction of the stop block is arranged in the abutment portion;

wherein the lug is configured to, in response to the rotary block being rotated with respect to the base along the first rotation direction, to be abutted against an inner wall at one end of the strip-shaped opening to drive the stop block to slide; and the lug is further configured to, in response to the rotary block being rotated with respect to the base along the second rotation direction, move in the strip-shaped opening but is not in structural interference with the abutment portion.

8. The seat adjustment module according to claim 1, wherein a plurality of position engagement portions are arranged on a circumferential side wall of the rotary block, and an engagement member is arranged on the base, wherein the engagement member is configured to be engaged with different position engagement portions in response to the rotary block being rotated.

9. The seat adjustment module according to claim 1, wherein the rotary block comprises a first body and a second body, wherein the first body is connected between the handle and the second body; and a torsional elastic member is connected between the first body and the second body, and the second body is configured to drive the stop block to slide by the transmission member.

10. The seat adjustment module according to claim 1, wherein a restoration elastic member is arranged between the stop block and the base, wherein the restoration elastic member is configured to apply a restoration elastic force to the stop block, such that the stop block is automatically restored and engaged with the seating member when no force is applied by the rotary block.

11. A seat frame assembly, comprising: a frame and a seat adjustment module, wherein the seat adjustment module is arranged on the frame; wherein the seat adjustment module comprises:

a base;

a stop block, slidably connected to the base, and configured to stop forward and backward movements of a seating member in a seat;

a rotary block, rotatably connected to the base, and configured to, in response to being rotated along a first rotation direction, drive the stop block to slide by a transmission member to release restrictions applied by the stop block on the forward and backward movements of the seating member, wherein the rotary block is further configured to, in response to being rotated along a second rotation direction, pull a first transmission rope to move to open a backrest adjustment switch in the seat, the second rotation direction being opposite to the first rotation direction;

a handle, rotatably connected to one end of the rotary block, and configured to, in response to being rotated with respect to the rotary block, pull a second transmission rope to move to open a lifter switch of the seat; and a twistable adjustment member, rotatably connected to the base, and configured to be connected to a backrest elastic force adjustment mechanism by a flexible transmission member, wherein the twistable adjustment member is configured to, in response to being rotated, adjust a magnitude of an elastic force of a backrest in the seat by the flexible transmission member.

12. The seat frame assembly according to claim 11, wherein the frame comprises a support frame and a seating member frame, wherein the seating member frame is forward and backward slidably connected to the support frame;

the seat adjustment module is arranged on the support frame, and the seat adjustment module is situated at a junction between the support frame and the seating member frame; and a slidable position section is arranged on the seating member frame, wherein the stop block is in a snap-fit engagement with the slidable position section.

13. The seat frame assembly according to claim 12, wherein the frame comprises a backrest, and the support frame comprises a chassis, an elastic sheet being arranged the chassis and the backrest; wherein a fulcrum structure is arranged on the chassis, the fulcrum structure being abutted against the elastic sheet such that the elastic sheet supplies a support elastic force to the backrest;

a rotatable adjustment member is connected to the fulcrum structure, and the flexible rotation member comprises a flexible rotary shaft, wherein the flexible rotary shaft is connected to the rotatable adjustment member, and the twistable adjustment member is configured to, in response to being rotated, drive the rotatable adjustment member to rotate by the flexible rotary shaft, such that the fulcrum structure slides with respect to the chassis to alter a magnitude of the support elastic force supplied by the elastic sheet to the backrest; or a tension mechanism is arranged on the chassis, and the flexible rotation member comprises a third transmission rope, wherein the third transmission rope is wound on the tension mechanism, two ends of the third transmission rope are wound and secured on the twistable adjustment member along an opposite direction, and the third transmission rope is securely connected to the fulcrum structure; and when the twistable adjustment member is rotated, the fulcrum structure is driven by the third transmission rope to slide with respect to the chassis to alter a magnitude of the support elastic force supplied by the elastic sheet to the backrest.

14. The seat frame assembly according to claim 11, wherein the rotary block is arranged to run through the base, one end of the rotary block is connected to the handle, and the twistable adjustment member is situated on an outer circumference of the handle; and a through hole configured to allow the second transmission rope to travel through is arranged in the base, the through hole being extended along the first rotation direction or the second rotation direction of the rotary block.

15. The seat frame assembly according to claim 11, wherein a transmission structure is circumferentially arranged on the twistable adjustment member, and a driven wheel is rotatably arranged on the base, wherein the driven wheel is transmissively engaged with the transmission structure, and the flexible transmission member is connected to the driven wheel.

16. The seat frame assembly according to claim 15, wherein the flexible transmission member comprises a third transmission rope, wherein two ends of the third transmission rope are wound and secured to the driven wheel along opposite directions, the driven wheel is configured to be connected to the backrest elastic force adjustment mechanism by the third transmission rope, and the twistable adjustment member is configured to, in response to being rotated, drive, via the driven wheel and the third transmission rope, the backrest elastic force adjustment mechanism to move to adjust the magnitude of the elastic force of the backrest in the seat; or the flexible transmission member comprises a flexible transmission shaft, wherein the driven wheel is configured to be connected to the backrest elastic force adjustment mechanism by the flexible transmission shaft, and the twistable adjustment member is configured to, in response to being rotated, drive, via the driven wheel and the flexible transmission shaft, the backrest elastic force adjustment mechanism to move to adjust the magnitude of the elastic force of the backrest in the seat.

17. The seat frame assembly according to claim 16, wherein the flexible transmission shaft comprises a flexible shaft.

18. The seat frame assembly according to claim 11, wherein a stop portion thereof is arranged at a first end of the stop block along a slide direction, wherein the stop portion is configured to be engaged with the seating member to stop the forward and backward movements of the seating member; and an abutment portion is arranged at a second end of the stop block along the slide direction thereof, wherein the transmission member is a lug arranged on a circumferential side wall of the rotary block, the rotary block is configured to, in response to being rotated with respect to the base along the first rotation direction, cause the lug to abut against the abutment portion to drive the stop block to slide such that restrictions applied by the stop block on the forward and backward movements of the seating member are released; and/or a connecting portion is arranged at the second end of the stop block along the slide direction thereof, wherein the transmission member is a fourth transmission rope connected between the connecting portion and the rotary block, the rotary block is configured to, in response to being rotated with respect to the base along the first rotation direction, pull the fourth transmission rope to move to drive the stop block to slide such that restrictions applied by the stop block on the forward and backward movements of the seating member are released.

19. The seat frame assembly according to claim 18, wherein a strip-shaped opening extending along the slide direction of the stop block is arranged in the abutment portion;

wherein the lug is configured to, in response to the rotary block being rotated with respect to the base along the first rotation direction, to be abutted against an inner wall at one end of the strip-shaped opening to drive the stop block to slide; and the lug is further configured to, in response to the rotary block being rotated with respect to the base along the second rotation direction, move in the strip-shaped opening but is not in structural interference with the abutment portion.

20. A seat, comprising: a seat frame assembly as defined in claim 11.

* * * * *